US006791278B2

(12) United States Patent
Russ et al.

(10) Patent No.: US 6,791,278 B2
(45) Date of Patent: Sep. 14, 2004

(54) FIELD EMISSION DISPLAY USING LINE CATHODE STRUCTURE

(75) Inventors: Benjamin Edward Russ, San Diego, CA (US); Jack Barger, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 10/305,527

(22) Filed: Nov. 27, 2002

(65) Prior Publication Data

US 2003/0193296 A1 Oct. 16, 2003

Related U.S. Application Data

(60) Provisional application No. 60/372,902, filed on Apr. 16, 2002.

(51) Int. Cl.[7] ..... G09G 3/10

(52) U.S. Cl. ..... 315/169.3; 313/307; 313/310; 313/509; 313/581; 313/586

(58) Field of Search ..... 315/160, 169.1, 315/169.3; 313/483, 506, 509, 581, 584, 586, 306, 307, 310

(56) References Cited

U.S. PATENT DOCUMENTS 3,665,241 A * 5/1972 Spindt et al. ..... 313/351
4,857,161 A * 8/1989 Borel et al. ..... 204/192.26
4,940,916 A * 7/1990 Borel et al. ..... 313/306
5,019,003 A * 5/1991 Chason ..... 445/24
5,053,673 A * 10/1991 Tomii et al. ..... 313/308
5,063,327 A * 11/1991 Brodie et al. ..... 313/482
5,216,324 A * 6/1993 Curtin ..... 313/495
5,245,247 A * 9/1993 Hosogi ..... 313/309
5,340,997 A * 8/1994 Kuo ..... 257/10
5,448,133 A * 9/1995 Ise ..... 313/497
5,508,584 A * 4/1996 Tsai et al. ..... 313/497
5,528,103 A * 6/1996 Spindt et al. ..... 313/497
5,548,185 A * 8/1996 Kumar et al. ..... 313/495
5,556,316 A * 9/1996 Taylor et al. ..... 445/50
5,565,742 A * 10/1996 Shichao et al. ..... 315/366
5,587,628 A 12/1996 Kuo ..... 315/169.3
5,614,785 A * 3/1997 Wallace et al. ..... 313/496
5,619,097 A * 4/1997 Jones ..... 313/495
5,649,847 A * 7/1997 Haven ..... 445/24
5,689,151 A * 11/1997 Wallace et al. ..... 313/495
5,717,287 A 2/1998 Amrine et al. ..... 313/495
5,773,921 A * 6/1998 Keesmann et al. ..... 313/309
5,811,926 A * 9/1998 Novich ..... 313/495
5,834,891 A * 11/1998 Novich ..... 313/495
5,880,554 A * 3/1999 Liu ..... 313/309
5,910,704 A * 6/1999 Choo ..... 313/495
5,962,959 A * 10/1999 Iwasaki et al. ..... 313/310
5,986,390 A * 11/1999 Chuman et al. ..... 313/310
5,986,625 A 11/1999 Huang et al. ..... 345/74.1

(List continued on next page.)

OTHER PUBLICATIONS

"Flat display screen cathode plate", Frayssinet et al., Pub. No. US 2002/0047559 A1, Apr. 25th, 2002, U.S. CI 315/169.3*

(List continued on next page.)

*Primary Examiner*—Thuy Vinh Tran
(74) *Attorney, Agent, or Firm*—Thomas F. Lebens; Fitch, Even, Tabin & Flannery

(57) ABSTRACT

An electron emitting structure, for example, for use as a cathode plate of a field emission display (FED). The structure comprises a substrate, base electrodes formed on the substrate and gate electrodes crossing over the base electrodes. An insulating material is formed on the substrate and the base electrodes that separates the gate electrodes from the base electrodes, the gate electrodes formed on the insulating material. And an electron emitting material is deposited on active regions of the base electrodes, each active region defined as a portion of each base electrode between a respective pair of gate electrodes. In one implementation, the FED produces a substantially uniform electric field in the active region in order to produce a substantially straight electron emission little dispersion.

34 Claims, 16 Drawing Sheets

U.S. PATENT DOCUMENTS

| | | | | | |
|---|---|---|---|---|---|
| 6,027,388 | A | | 2/2000 | Jones et al. | 445/24 |
| 6,031,328 | A | * | 2/2000 | Nakamoto | 313/495 |
| 6,039,622 | A | * | 3/2000 | Kosaka et al. | 445/52 |
| 6,064,148 | A | * | 5/2000 | Tolt et al. | 313/495 |
| 6,066,922 | A | * | 5/2000 | Iwasaki et al. | 315/169.3 |
| 6,094,001 | A | * | 7/2000 | Xie | 313/309 |
| 6,097,138 | A | * | 8/2000 | Nakamoto | 313/309 |
| 6,136,621 | A | | 10/2000 | Jones et al. | 438/20 |
| 6,144,144 | A | * | 11/2000 | Cleeves et al. | 313/309 |
| 6,146,230 | A | * | 11/2000 | Kim et al. | 445/51 |
| 6,149,484 | A | * | 11/2000 | Amrine et al. | 445/41 |
| 6,153,969 | A | * | 11/2000 | Levine | 313/309 |
| 6,194,333 | B1 | | 2/2001 | Ryu | 501/32 |
| 6,323,831 | B1 | * | 11/2001 | Ono et al. | 345/75.2 |
| 6,359,383 | B1 | * | 3/2002 | Chuang et al. | 313/496 |
| 6,377,002 | B1 | * | 4/2002 | Ge et al. | 315/366 |
| 6,486,597 | B1 | | 11/2002 | Goel et al. | 313/422 |
| 6,509,677 | B2 | * | 1/2003 | Xia et al. | 313/309 |
| 6,515,429 | B2 | * | 2/2003 | Russ et al. | 315/169.3 |
| 6,559,602 | B2 | * | 5/2003 | Russ et al. | 315/169.1 |
| 6,590,320 | B1 | * | 7/2003 | Abanshin et al. | 313/309 |
| 6,650,061 | B1 | * | 11/2003 | Urayama et al. | 315/169.3 |
| 2001/0028215 | A1 | * | 10/2001 | Kim | 313/495 |
| 2002/0185950 | A1 | * | 12/2002 | Russ et al. | 313/310 |
| 2002/0185951 | A1 | * | 12/2002 | Russ et al. | 313/310 |
| 2002/0185964 | A1 | * | 12/2002 | Russ et al. | 313/496 |
| 2002/0187706 | A1 | * | 12/2002 | Russ et al. | 445/24 |
| 2002/0187707 | A1 | * | 12/2002 | Russ et al. | 445/24 |
| 2002/0195959 | A1 | * | 12/2002 | Russ et al. | 315/169.3 |

OTHER PUBLICATIONS

Candescent Technologies, *ThinCRT Showcase*, http://www.candescent.com/Candescent/showcase.htm, Jan. 16, 2001, pp. 1–4. Candescent Technologies Corporation.*

Candescent Technologies, *ThinCRT Technology*, http://www.candescent.com/Candescent/tcrnch.htm, Jan. 16, 2001, pp. 1–3, Candescent Technologies Corporation.*

Candescent Technologies, *The ThinCRT Concept*, http://www.candescent.com/Candescent/tcncnpt.htm, Jan. 16, 2001, pp. 1–6, Candescent Technologies Corporation.*

Candescent Technologies, *Candescent ThinCRT Technology Primer*, http://www.candescent.com/Candescent/techprim.htm, Jan. 16, 2001, pp. 1–5, Candescent Technologies Corporation.*

ITO et al, *Carbon–Nanotube–Based Triode–Field–Emission Displays Using Gated Emitter Structure*, IEEE Electron Device Letters, Sep. 2001, pp. 426–428, vol. 22, No. 9.*

* cited by examiner

FIELD EMISSION DISPLAY USING LINE CATHODE STRUCTURE

This application claims priority under 35 U.S.C. §119(e) to U.S. Provisional Patent Application No. 60/372,902, filed Apr. 16, 2002, of Barger et al., for LOW CAPACITANCE STRUCTURE FOR FED CATHODE, which U.S. Provisional Patent Application is incorporated herein by reference.

BACKGROUND OF THE INVENTION

1. Field of the Invention

The present invention relates generally to flat panel displays (FPDs), and more specifically to field emission displays (FEDs). Even more specifically, the present invention relates to the cathode structure of a field emission display (FED).

2. Discussion of the Related Art

A field emission display (FED) is a low power, flat cathode ray tube type display that uses a matrix-addressed cold cathode to produce light from a screen coated with phosphor materials. FIG. 1 is a cross sectional view of a conventional FED. The FED 100 includes a cathode plate 102 and an anode plate 104, which opposes the cathode plate 102. The cathode plate 102 includes a substrate 106, cathodes or base electrodes 107 printed on the substrate 106, a first dielectric layer 108 disposed on the substrate 106 and the base electrodes 107, 109, 111, and a gate electrode 114 disposed on the first dielectric layer 108 and several emitter wells 110 formed within the gate electrode 114 and the first dielectric layer 108, such that the gate electrode 114 and the first dielectric layer 108 circumscribe each emitter well 110. A conical shaped electron emitter 112, e.g., a Spindt tip, is deposited within each emitter well 110. A typical well 110 is approximately 1 $\mu$m in diameter. In order to precisely align the gate electrode 114 with the emitters 112, the wells 110 are formed by etching or cutting them out of the first dielectric layer 108 and the gate electrode 114 then placing or depositing an emitter 112 within each well 110.

The anode plate 104 includes a transparent substrate 116 upon which is formed an anode 118. Various phosphors are formed on the anode 118 and oppose the respective emitters 112, for example, a red phosphor 120, a green phosphor 122 and a blue phosphor 124.

It is important in FEDs that the particle emitting surface of the cathode plate 102 and the opposed anode plate 104 be maintained insulated from one another at a relatively small, but uniform distance from one another throughout the full extent of the display face in order to prevent electrical breakdown between the cathode plate and the anode plate, provide a desired thinness, and to provide uniform resolution and brightness. Additionally, in order to allow free flow of electrons from the cathode plate 102 to the phosphors and to prevent chemical contamination, the cathode plate 102 and the anode plate 104 are sealed within a vacuum, e.g., less than $10^{-6}$ torr. In order to maintain the desired uniform separation between the cathode plate 102 and the anode plate 104 across the dimensions of the FED in the pressure of the vacuum, structurally rigid spacers (not shown) are positioned between the cathode plate 102 and the anode plate 104.

The FED 100 operates by selectively applying a voltage potential between a respective one or more of the base electrodes 107, 109, 111 and the gate electrode 114, producing an electric field focused to cause a selective emission from the tips of the emitters 112. FIG. 2 illustrates an electric field 202 produced, which focuses on the tip of the emitter 112 in order to cause the electron emission 204. The emitted electrons are accelerated toward and illuminate respective phosphors of the anode 118 by applying a proper potential to the anode 118 containing the selected phosphor.

In another conventional FED illustrated in FIG. 3, an FED 300 further includes a second dielectric layer 302 disposed upon the gate electrode 114 and a focusing electrode 304 disposed upon the second dielectric layer 302. In operation, a potential is also applied to the focusing electrode 304 to collimate the electron emission from respective emitters 112. Thus, the focusing electrode 304 concentrates the electrons to better illuminate a single phosphor and to reduce the spread of electrons, this spread illustrated in the emission 204 of FIG. 2.

FIG. 4 illustrates yet another conventional FED design. In this design, the FED 400, multiple emitters 112 are deposited within wells 110 over each base electrode, e.g., base electrode 107. In operation, the electron emission from each of the emitters 112 on a given base electrode, e.g., base electrode 107, are directed toward a single phosphor, e.g., phosphor 120. Since the emission isn't focused, the phosphor 120 is slightly oversized relative to the base electrode 107 such that only the intended phosphor is illuminated.

FIG. 5 illustrates a cut-away perspective view of the conventional FED 100 of FIG. 4. As shown, the gate electrode 114 and the first dielectric layer 108 form a grid in which the generally circular-shaped emitter wells 110 are formed. In fabrication, the cathode substrate 106 is screen printed with the base electrodes 107, 109, 111 (electrode 107 is illustrated). Next, the first dielectric layer 108 is formed over the substrate 106 and the respective base electrodes 107, 109, 111. A gate electrode layer is applied over the first dielectric layer 108. The wells 110 and gate electrode 114 are formed by etching the first dielectric layer 108 and the gate electrode layer. The emitters 112 are then deposited into the emitter well 110.

SUMMARY OF THE INVENTION

The invention provides an electron emitting structure, for example, for use as a cathode plate of a field emission display (FED). According to several embodiments, the electron emitting structure includes base electrodes having active regions configured such that an emitter material, for example, several emitter portions or a continuous emitter material is deposited on each active region. In preferred form, the electron emitting structure produces a substantially uniform electric field across the active region resulting in a substantially straight electron emission, which does not require a separate focusing structure. Furthermore, in preferred form, the electron emitting structure has a low drive voltage and a low capacitance, which improves the refresh rate and resolution and allows the use thereof in large screen FEDs.

In one embodiment, the invention can be characterized as an electron emitting structure comprising a substrate, base electrodes formed on the substrate, and gate electrodes formed above and crossing over the base electrodes. An insulating material is formed on the substrate and the base electrodes that separates the gate electrodes from portions of the base electrodes, the gate electrodes formed on the insulating material. And an electron emitting material is deposited on active regions of the base electrodes, each active region defined as a portion of each base electrode between a respective pair of gate electrodes.

In another embodiment, the invention can be characterized as a method of electron emission comprising the steps of: applying a first potential to a respective one of a plurality of base electrodes formed on a substrate of an electron emitting structure; applying a second potential to each of a pair of gate electrodes crossing over the respective one of the plurality of base electrodes, the pair of gate electrodes each separated from the base electrode by an insulating material formed on a portion of the base electrode and the substrate, the gate electrodes formed on the insulating material; and producing an electric field across an active region of the respective one of the plurality of base electrodes as a result of the applying the first potential and the applying the second potential, the electric field sufficient to cause an electron emission from an electron emitting material located on the active region of the respective one of the plurality of base electrodes, the active region defined as a portion of the base electrode between the pair of gate electrodes.

In a further embodiment, the invention may be characterized as a field emission display including a cathode plate and an anode plate. The cathode plate comprises: a substrate; base electrodes formed on the substrate, the base electrodes functioning as cathodes; gate electrodes formed above and crossing over the base electrodes; insulating material formed on the substrate and portions of the base electrodes that separates the gate electrodes from the base electrodes and electrically insulating the base electrodes from the gate electrodes, the gate electrodes formed on the insulating material; and an electron emitting material deposited on active sub-pixel regions of the base electrodes, each active sub-pixel region defined as a portion of each base electrode between a respective pair of gate electrodes. The anode plate comprises: a transparent substrate separated above the substrate; and phosphor material coupled to the transparent substrate, portions of the phosphor material corresponding to active sub-pixel regions of the base electrodes.

BRIEF DESCRIPTION OF THE DRAWINGS

The above and other aspects, features and advantages of the present invention will be more apparent from the following more particular description thereof, presented in conjunction with the following drawings.

Corresponding reference characters indicate corresponding components throughout the several views of the drawings.

DETAILED DESCRIPTION

Figure 1:
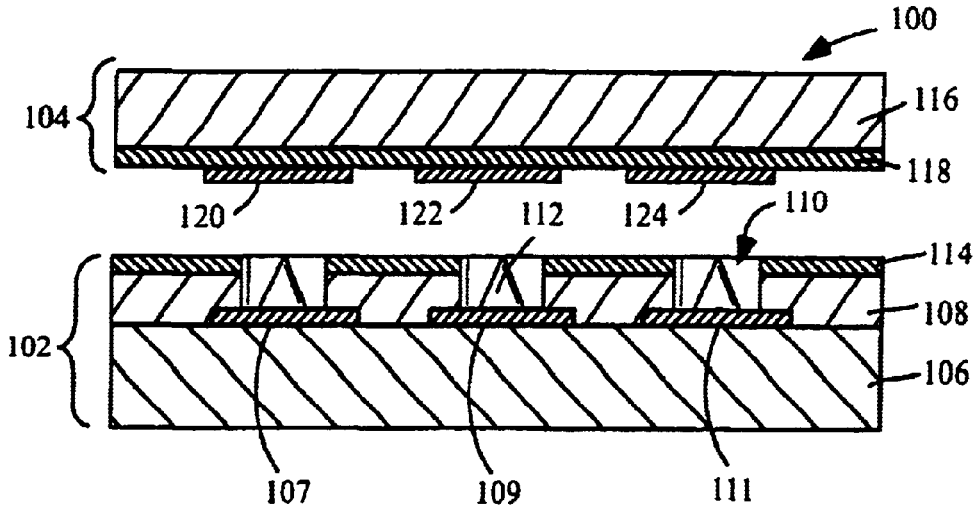
Fig. 1 (Prior Art)
FIG. 1 is a cross sectional view of a conventional field emission display (FED).

The following description is not to be taken in a limiting sense, but is made merely for the purpose of describing the general principles of the preferred embodiments. The scope of the invention should be determined with reference to the claims.

According to several embodiments of the invention, an electron emitting structure is provided that produces a substantially uniform electric field resulting in a substantially straight electron emission. In preferred form, the electron emitting structure is used as a cathode plate of a field emission display (FED), which advantageously, does not require a separate focusing structure. An electron emitting structure is provided which includes linear base electrodes (also referred to as cathode lines) formed across a substrate and linear gate electrodes (referred to as gate lines) crossing over the base electrodes. The gate electrodes are separated from the base electrodes by a dielectric or insulating material that is formed over portions of the base electrodes, the gate electrodes formed over the insulating material.

Active regions of the base electrodes are defined as regions of the base electrodes where an electron emitting material may be deposited. For example, in one embodiment, active regions are defined as regions of the base electrodes in between corresponding gate electrodes, e.g., bounded on at least 2 opposite sides by insulating material. An emitter material (e.g., several emitter portions, tips or nanotubes or a continuously deposited emitter material) is deposited on each active region. In preferred embodiments in use as a cathode plate of a field emission display, the active regions of the base electrodes may be referred to as cathode sub-pixel regions, each cathode sub-pixel region corresponding to a sub-pixel of the display device.

Each active region is driven by applying an appropriate voltage to a respective base electrode and applying an appropriate voltage to adjacent gate electrodes defining the respective active region. A substantially uniform electric field is produced across the active region, which is sufficient to cause a substantially straight electron emission from electron emitting material on the active region. According to several embodiments, although the emission is substantially straight, overdriving or underdriving the gate electrodes will allow for slight adjustments to the focus of the emission.

Furthermore, the electron emitting structure significantly reduces crosstalk, i.e., reduces electrons unintentionally emitted from adjacent active regions. Additionally, in preferred embodiments, the area of the portion of the base electrode underneath a respective gate electrode and separated by an insulating material is reduced in order to reduce the capacitance generated between the base electrode and the gate electrode thereabove, which significantly lowers the time to charge a given base electrode and gate electrodes; thus, the device may be driven faster with a higher refresh rate and better resolution, such that large screen, drivable FEDs are provided.

Figure 6:
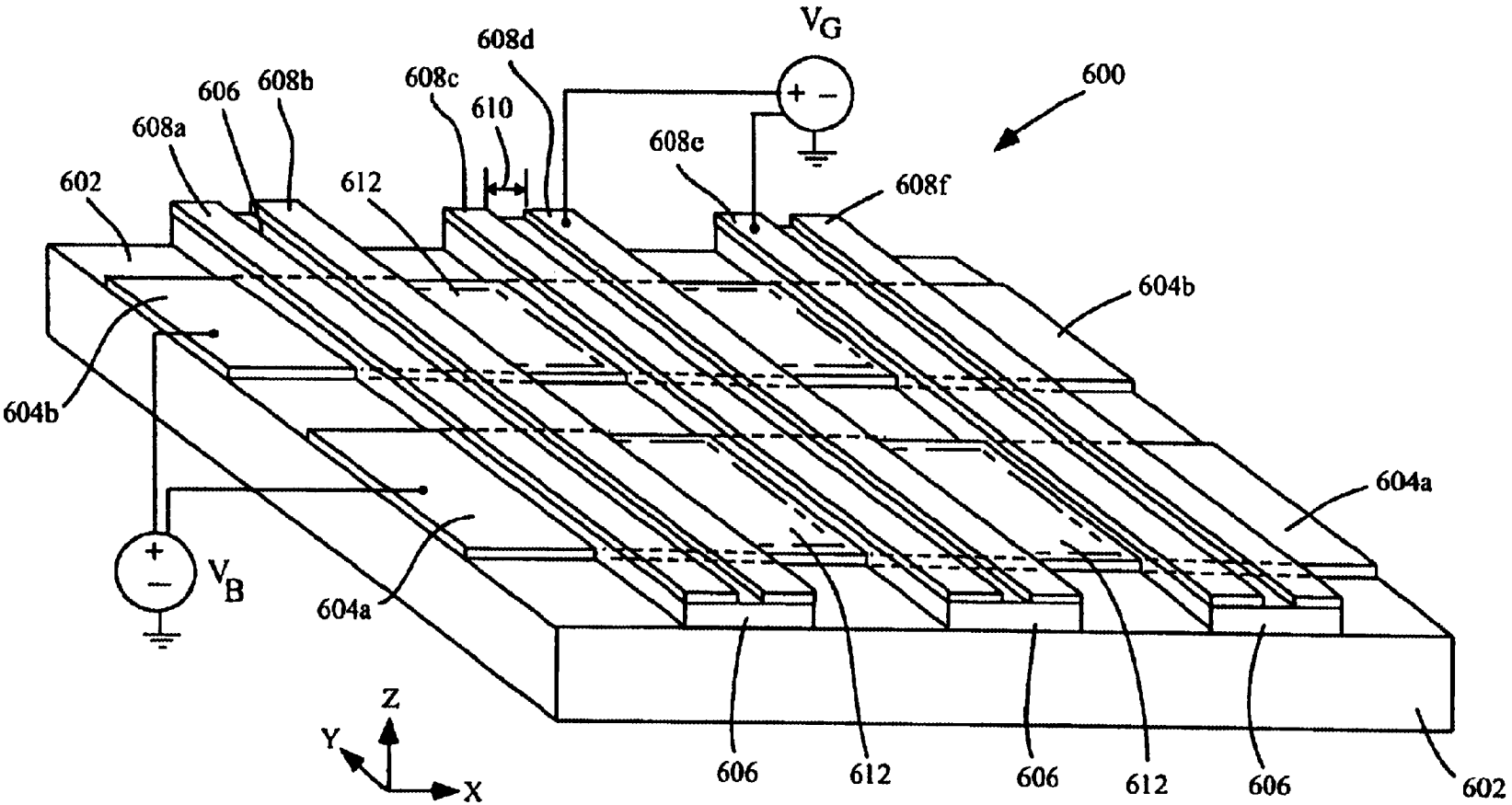
FIG. 6 is a perspective view of a portion of an electron emitting structure used for example, as a cathode plate of a field emission display (FED), in accordance with the present invention including gate electrodes crossing over base electrodes, the gate electrodes formed on and separated from the base electrodes by an insulating material formed on the base electrodes, the insulating material illustrated as linear insulating members.
Figure 7:
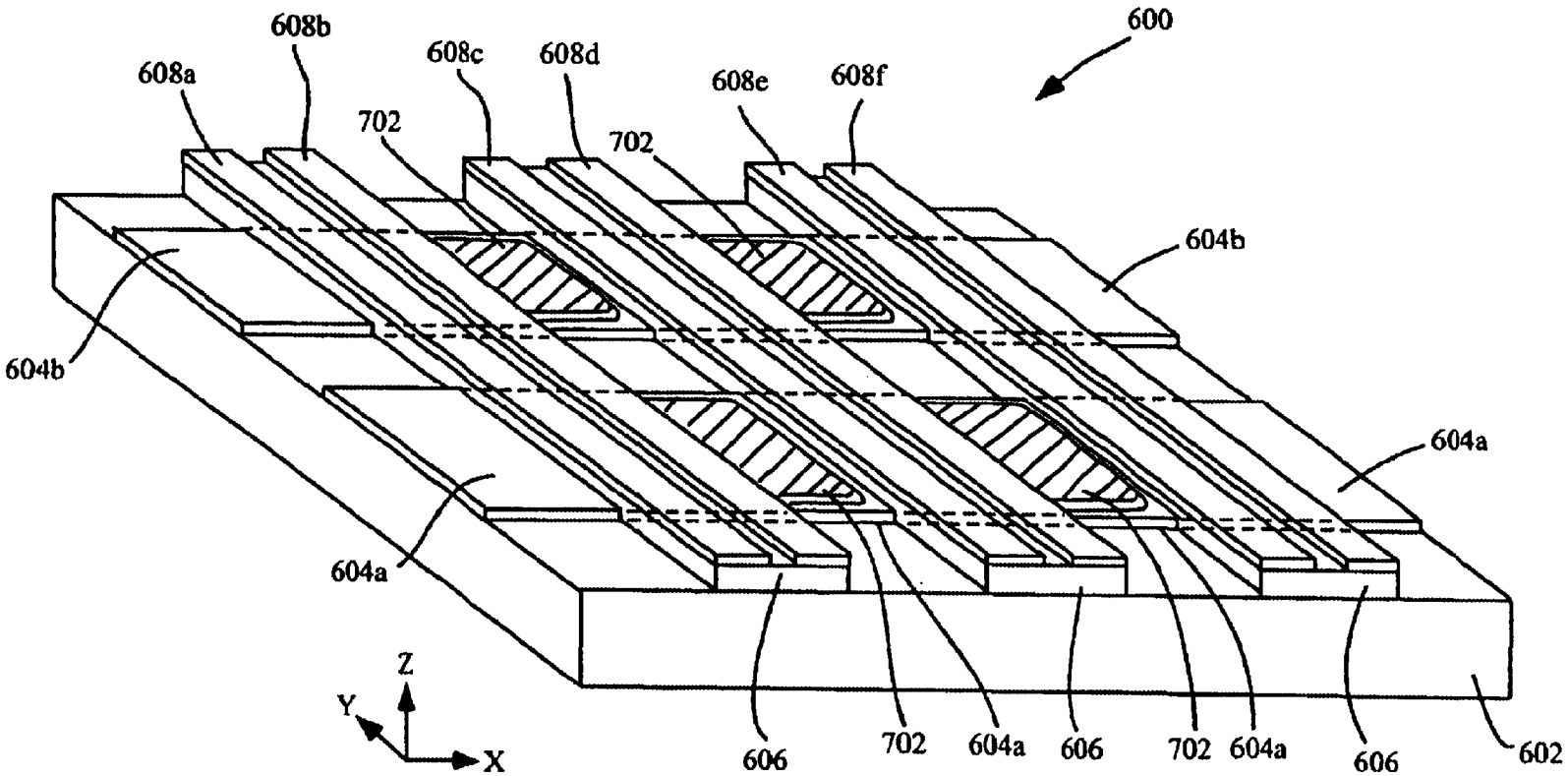
FIG. 7 is a perspective view of the electron emitting structure of FIG. 6 including electron emitting material deposited on active regions of the base electrodes.

Referring to FIGS. 6 and 7, perspective views are shown of a portion of an electron emitting structure, used for example as a cathode plate of a field emission display (FED), in accordance with the present invention including insulating members and gate electrodes formed over and crossing over base electrodes. Illustrated is the electron emitting structure 600 or plate including a substrate 602; base electrodes 604 (also referred to as cathodes of an FED, and with individual base electrodes 604 illustrated as 604*a* and 604*b*) printed on the substrate 602; and gate electrodes 608 (individual gate electrodes 608 illustrated as 608*a*, 608*b*, 608*c*, 608*d*, 608*e* and 608*f*) crossing over the linear base electrodes 604. The base electrodes 604 are embodied as lines of conductive metallic material. The gate electrodes 608 are separated from the base electrodes 604 by an insulating material, which is embodied as insulating members 606 (also referred to as ribs, barriers or lines) of a dielectric material formed over the substrate 602 and the base electrodes 604. The gate electrodes are formed over the insulating material, e.g., two gate electrodes are formed over each insulating member 606. The gate electrodes 608 are preferably embodied as ribbons or lines of conductive material that are separated from the base electrodes 604 by the dielectric material and cross over base electrodes 604. It should be understood that the insulating material may take on many alternative geometries than the illustrated linear insulating members 606.

According to well known practices, the base electrodes 604 are sputtered on the substrate 602 out of a suitable conducting material, e.g., gold, chrome, molybdenum, platinum, etc. The base electrodes 604 form rows spanning the substrate 602. A layer of photosensitive dielectric material, e.g., ceramic or glass, is then spin coated or formed over the base electrodes 604 and the substrate 602. Next a layer of conductive gate electrode material is formed over the layer of dielectric material. Then, the gate electrode material layer and the dielectric material layer are patterned using photolithography, for example, and etched away to form the gate electrodes 608 over the insulating members 606, as illustrated in FIG. 6.

Generally, active regions 612 (also referred to as cathode sub-pixel regions in an FED) of each base electrode 604 are regions where an electron emitting material is deposited and are defined as the regions of the base electrodes 604 below and in between a respective pair of gate electrodes 608, e.g., the region of the base electrode 604 in between gate electrodes 608*b* and 608*c* and in between gate electrodes 608*d* and 608*e*. In the illustrated embodiment, the active regions are also defined the regions of the base electrodes 604 below and in between a respective pair of gate electrodes 608 on adjacent insulating members 606, e.g., the region of the base electrode 604 in between gate electrodes 608*b* and 608*c* and in between gate electrodes 608*d* and 608*e*. As such, in the embodiment of FIG. 6, each active region 612 is bounded on opposite sides by each of the respective pair of gate electrodes and also bounded on opposite sides by an insulating material, i.e., adjacent linear insulating members 606. Next, an electron emitter material is deposited on the active regions 612 of each base electrode 604 as illustrated in FIG. 7.

As illustrated, the base electrodes 604 extend substantially parallel to each other across the substrate 602. In preferred form, the base electrodes 606 form rows extending across the substrate 602. The linear insulating members 606 extend across the substrate 602 substantially parallel to each other while crossing over the base electrodes 604. For example, preferably, the insulating members 606 form columns that cross over the base electrodes 604 and are perpendicular to the base electrodes 604. Thus, according to one embodiment, the linear insulating members 606 resemble ribs or ridges of dielectric material having linear trenches or channels formed therebetween. In this embodiment, two gate electrodes 608 are formed on the upper surface of a given insulating member 606 (e.g., gate electrodes 608*a* and 608*b*), each of the two gate electrodes belonging to a different respective pair of gate electrodes defining a respective active region 612 on the base electrode therebetween. Each gate electrode 608 formed on a given insulating member 606, e.g., gate electrodes 608*a* and 608*b*, is separated from each other by a distance 610, such that there is no conductive material in between each gate electrode 608. In preferred embodiments, the gate electrodes 608 are flush with a respective outer edge of a respective insulating member 606. Additionally, each gate electrode 608 is a continuously layer of conducting material that is formed over an insulating material layer.

As noted above, in this embodiment, the region on each base electrode 604 below and in between gate electrodes 608 on adjacent linear insulating members 606 is defined as an active region 612. In the embodiment illustrated, each active region 612 is a rectangular region that is bounded on one set of opposite sides by dielectric material, i.e., insulating members 606. In a preferred embodiment sized for a 21 inch FED, the active region 612 is approximately 50 $\mu$m by 250

μm; thus, having an area of approximately 12,500 $\mu m^2$. This is on contrast to the emitter well design of conventional FEDs in which each emitter well is approximately 1 μm in diameter and an area of about 0.8 $\mu m^2$ and is surrounded on all sides (along its rim) by a dielectric material and gate electrode material.

Electron emitting material 702 is deposited on each active region 612 of the base electrodes 604. The electron emitting material 702 may be any low work function material that easily emits electrons, for example, a carbon-based material such as carbon graphite or polycrystalline carbon. Additionally, those skilled in the art will recognize that the emitter material 702 may comprise any of a variety of emitting substances, not necessarily carbon-based materials, such as an amorphous silicon material, for example.

In one embodiment, the emitter material 702 comprises a plurality of discrete electron emitting portions that are deposited to substantially cover the active region 612. For example, the emitter material 702 comprises many tiny emitter cones (i.e., Spindt tips) positioned closely together, such that collectively, the many emitter cones form the emitter material 702. In this embodiment, there is no dielectric material or other insulating or separating structure in between individual emitter cones. Similarly, there is no gate electrode material above and in between individual emitter cones. This is in contrast to the individual emitter cones located within individual emitter wells as shown in FIGS. 1–5, where each individual emitter 112 is deposited within a respective well 110 such that each emitter is separated by dielectric material and gate electrode material.

In some embodiments, rather than using cones or tips of emitter material, the emitter material 702 the plurality of electron emitting portions comprise single wall or multi-wall nanotubes. For example, known single wall nanotubes have a tube-like structure approximately 1–100 μm tall and 1–7 nm in diameter, while multiwall nanotubes have approximately 1–100 μm tall and 10–100 nm. Many nanotubes are deposited on the base electrode 604 within the active region 612. In the embodiment where the active region is 50×250 μm, several hundred nanotubes may be deposited within a given active region 612. Preferably, the nanotubes are spaced about 1–2 μm apart such that the height to spacing ratio is about 1:2. It has been found that in some embodiments, if the nanotubes are positioned too close together, the nanotubes shield the electric field, thus, reducing the electric field at the emitting surface.

It is noted it is not required that the spacing between nanotubes or emitter cones, or other pieces of discrete emitter portions be consistent. For example, many emitting portions may be spaced optimally apart (1:2 height to spacing ratio) as described above; however, many may be spaced closer than optimal. Thus, advantageously, the emitter material may be deposited in a relatively random pattern such that the emitter material substantially covers the active region 612. Furthermore, as will be described more fully below, the emitter material 702 is preferably not deposited about the entire active region 612, e.g., the emitting material 702 is preferably not deposited along the periphery edges of the active region since the electric field is slightly higher at the edges and substantially more uniform in between.

In a broad sense, the active regions 612 of the base electrodes 604 are a departure from the traditional emitter in well structure since more than one electron emitter portion (e.g., nanotube, tip, etc.) is deposited on the active region, the more than one electron emitter not separated by a dielectric material formed therebetween. Thus, the more than one electron emitter portion is also not separated by gate electrode material above and between individual emitter portions. Advantageously, this allows for the electric field produced in the active region to be substantially uniform across the active region 612.

It is noted that while in preferred embodiments, the active region 612 is sized for a 21 inch FED display (i.e., the active region 612 in one embodiment is 50×250 μm), the active region may be scaled to any desired dimensions. However, in preferred embodiments, the active region 612 should be large enough to allow the at least two discrete electron emitting portions, e.g., tips, cones, pyramids, nanotubes, etc., to be deposited thereon, the individual emitter portions not separated by gate electrode material or dielectric material therebetween. For example, the width of the active region (i.e., the distance from one gate electrode 608*b* to the opposite gate electrode 608*c* should be at least 2 μm, preferably at least 10 μm and most preferably at least 25 μm, while the length may be varied depending on the size of the pixel and display desired. For example, for a 21 inch display, the active region 612 is 50 μm wide and 250 μm in length.

Furthermore, in some embodiments, rather than comprising a plurality of discrete electron emitting portions, the electron emitting material 702 is simply a layer of emitting material that is applied to the active region. That is, the electron emitting material 702 is a continuous material (e.g., a powder or a molten liquid that hardens or a thin continuous film) substantially covering the active region 612. This continuous layer is preferably deposited to have a substantially uniform depth across the active region. This is a departure from the known tip emitter within well design since the emitter material is spread out over a larger area and additionally lacks a distinct tip or focal point for the electric field, i.e., the depth of the tip emitter varies dramatically from base to tip to base. Furthermore, the gate electrode material (e.g., gate electrodes 608) is spread farther apart compared to conventional FED wells, which allows for more emitter material to be deposited in between gate electrode material. Such design allows for a substantially uniform electric field within the active region and across the area of the continuous emitter material, which causes electrons to be substantially uniformly emitted from the emitter material.

Additionally, the emitter material 702 is preferably substantially uniformly deposited as a smooth layer having a relatively constant thickness, depth or height on the active region 612, which in some embodiments is helpful in producing a substantially uniform electron emission. In another embodiment, the emitter material 702 may be made such that it has an uneven height, or has bumps, throughout the active region 612.

Figure 20:
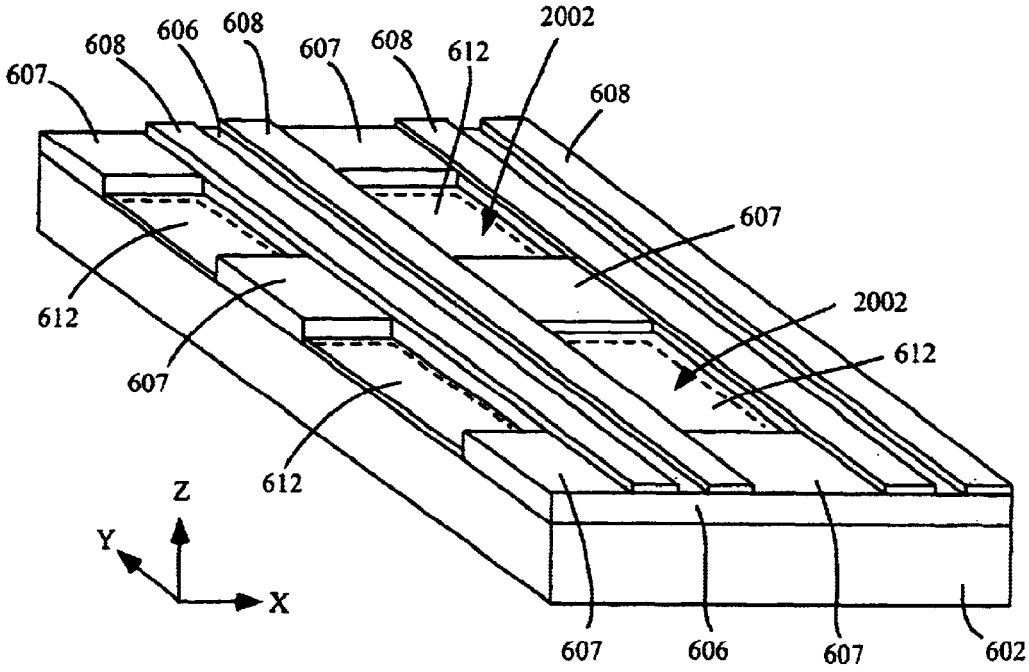
FIG. 20 is an alternative embodiment of the electron emitting structure of FIG. 6 in which the insulating material includes the insulating members extending linearly across the base electrodes and linearly in between the base electrodes thus defining the active regions.

In the embodiment of the FIGS. 6–7, the active regions 612 are bounded on opposite sides by dielectric material, e.g., linear insulating members 606. However, it is noted that alternatively, each active region 612 may be bounded on all sides by a dielectric material. For example, the insulating members 606 may extend across the base electrodes 604 as illustrated and also have portions that extend parallel to and in between the base electrodes 604, such as illustrated in FIG. 20, without affecting the electric field or the resulting emission from the active region. In this alternative embodiment, the active region 612 is still defined by gate electrodes on either side and is still sized to allow two or more discrete electron emitting portions or a continuously applied electron emitter material deposited thereon, the two or more portions not separated from each other by dielectric material. In yet another embodiment, the active region may be segmented into smaller portions, for example, by one or more ribs of dielectric material extending over the active region, such as described with reference to FIG. 21. Again, each divided active region is defined by the gate electrodes on either side and still are large enough to allow two or more discrete electron emitting portions or continuously applied material deposited thereon and do not substantially affect the generated electric field.

In operation of the electron emitting structure 600, each base electrode 604 is coupled to a base drive voltage $V_B$, which is controlled via driving/addressing software. Each gate electrode 608 is coupled to a gate drive or gate voltage $V_G$, which is controlled via driving/addressing software. The driving/addressing software uses known row and column addressing and driving techniques. In order to cause an electron emission, a voltage potential to applied to a respective base electrode, e.g., base electrode 604*a*, and a voltage potential is applied to the gate electrodes on either side of the active region on adjacent insulating members 606, e.g., gate electrodes 608*b* and 608*c*. The application of appropriate potentials produces an electric field across the active region 612 that is sufficient to cause an electron emission from the emitter material 702 on the active region 612. In preferred embodiments, through the selection of emitting materials, such as carbon-based nanotubes, a potential difference of approximately 20 volts between the base electrode 604 voltage and the gate electrode 608 voltages will result in an electric field that causes such an electron emission.

Advantageously, according to several embodiments, due to the geometry of the base electrodes 604 and the gate electrodes 608, the electric field produced is substantially uniform across the active region 612 such that the electron emission is substantially straight up from the emitting surface. Thus, a focusing electrode or other focusing structure is not required in order to limit the spread of the electron emission. Furthermore, as described above, the active region 612 is sized large enough such that at least two emitting material portions (e.g., tips, cones, nanotubes, or other structure) may be deposited on each active region 612 of each base electrode 604. For example, in one embodiment, the active region 612 about 10–200 $\mu$m ×50–500 $\mu$m.

In a preferred embodiment, the electron emitting structure is sized for a 21 inch display. For example, the base electrodes 604 are each about 50 $\mu$m wide and about 1000 angstroms thick extending about the substrate 602, and spaced about 20 $\mu$m apart. The linear insulating members 606 are each about 50 $\mu$m wide, about 10 $\mu$m thick and spaced about 50 $\mu$m apart. Each gate electrode 608 is about 20 $\mu$m wide and about 1000 angstroms thick extending the length of the insulating member 606 such that each respective gate electrode defines a respective edge of an active region. Adjacent gate electrodes 608 on a given insulating member 606 are spaced about 10 $\mu$m apart. Gate electrodes of a respective pair of gate electrodes defining an active region 612 are spaced about 50 $\mu$m apart. Thus, each active region 612 is about 50 $\mu$m in width and 250 $\mu$m in length. Furthermore, the electron emitting material 702 comprises carbon-based nanotubes having a height of about 3 $\mu$m and a diameter of about 1–10 nm and are deposited to cover a central region of the active region 612 between 50–99%, more preferably, between 55–90% and most preferably, between 60–80% of the surface area of the active region 612. It is noted that the dimensions of the various components may be altered depending on the specific implementation without departing from the invention.

Figure 8:
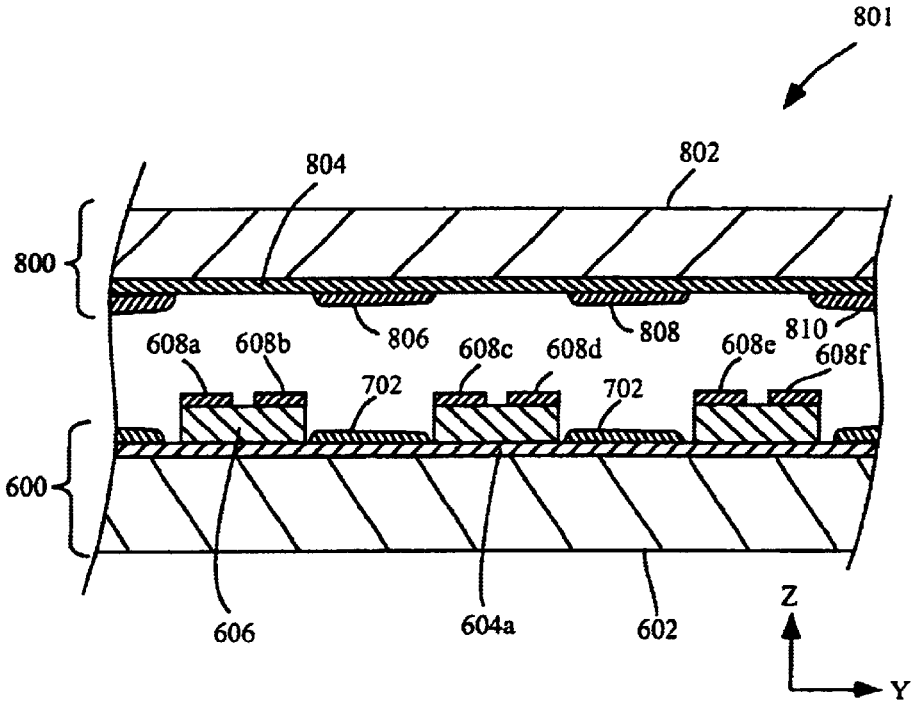
FIG. 8 is a cross sectional view of an FED using the electron emitting structure of FIGS. 6–7 and including an anode plate.

As illustrated in the cross-sectional view of FIG. 8, an anode plate 800 is maintained a small and substantially uniform distance above the electron emitting structure 600 (e.g., cathode plate) across the dimensions of the display. The anode plate 800 includes a transparent substrate 802, e.g., a glass substrate. The substrate 802 includes a thin anode material 804 that phosphor material is deposited thereon, e.g., phosphors 806 (e.g., red), 808 (e.g., green) and 810 (e.g., blue). Preferably, the phosphors 806, 808 and 810 extend linearly about the substrate 802 and run parallel to the insulating members 606 and the gate electrodes 608. This gives the FED 801 a SONY® TRINITRON®-like appearance, i.e., the substrate 802 has solid lines of phosphor material (i.e., a striped anode) rather than dots of phosphor materials in traditional pixelized FEDs. However, it is understood that the phosphors 806, 808 and 810 could be formed as lines running parallel to the base electrodes 604, or alternatively, the phosphors could be formed as dots or spots rather than lines on the substrate 802 directly above each corresponding active region 612. It is also understood that the phosphor material may be directly deposited on the substrate 802 with a thin anode material coating formed thereover. It is noted that a suitable non-transmissive or opaque (black) substance may be applied to the transparent substrate 802 in between phosphors.

In operation, by selectively applying a voltage potential to a respective base electrode 604 and two gate electrodes 606 on opposite sides of a respective active region, e.g., gate electrodes 606*b* and 606*c*, the emitter material 702 deposited on the respective active region 612 will emit electrons toward and illuminate a corresponding portion (i.e., an anode sub-pixel region) of a corresponding phosphor, e.g., phosphor 806, formed on the anode plate 802 above. Furthermore, as is similarly done in conventional FEDs, in order to accelerate the electron emission toward the phosphor material providing greater brightness of the illuminated anode sub-pixel region of phosphor, a potential is also applied to the anode material 804.

According to preferred embodiments, since the electric field produced is substantially uniform across the active regions and the resulting electron emission is generally straight up with little dispersion, the phosphors may be sized to more closely match the size of the active region 612. For example, in many conventional FEDs, the spread of an electron emission is not focused, but rather the corresponding phosphor is made larger than the area covered by the emitters forming the cathode sub-pixel, such that all of the spread electrons strike the desired phosphor. Advantageously, since the electron emission according to several embodiments is substantially straight up with little dispersion, the phosphor material does not have to be oversized without using additional focusing electrodes.

Furthermore, the FED device incorporates spacers (not shown) that will prevent the anode plate 800 from collapsing on the electron emitting structure 600 in the vacuum. These spacers may be implemented as one or more thin wall segments (e.g., having an aspect ratio of 10–50×1000 $\mu$m) evenly spaced across the substrate. For example, the wall-like or rib-like spacers are preferably parallel to or on the insulating members 606 and located at a desired spacing across the display, e.g., for a 5 inch display, one spacer every 25 mm. Additionally, spacers are preferably located in between pixels (a grouping of three sub-pixel regions, e.g., red, green and blue). Alternatively, these spacers may be implemented as support pillars that are evenly spaced across the substrate 602.

According to preferred embodiments, in addressing and driving the electron emitting structure 600, since a voltage difference of about 20 volts between a given base electrode 604 and adjacent gate electrodes 608 is needed to create an electron emission, a voltage potential of −10 volts is selectively applied to a respective base electrode, e.g., base electrode 604*a*, where an un-energized state of the base electrode is at 0 volts. At the same time, a voltage potential of +10 volts is applied to the gate electrodes on either side of the active region, e.g., gate electrodes 608*b* and 608*c*, where the gate electrodes 608*b* and 608*c* are each located on separate insulating members 606, and where an un-energized state of the gate electrodes 608 is at 0 volts. Thus, at different active regions 612 of the electron emitting structure 600 (see also FIG. 19), there is a voltage difference of either 0 volts (0 volts at the base electrode and a corresponding pair of gate electrodes), 10 volts (i.e.,−10 volts at the base electrode and 0 volts at the corresponding pair of gate electrodes, or 0 volts at the base electrode and +10 volts at the corresponding pair of gate electrodes ) or 20 volts (−10 volts at the base electrode and +10 volts at the corresponding pair of gate electrodes) between the respective active region 612 and the corresponding pair of gate electrodes 608 defining the active region 612, e.g., the gate electrodes formed on the insulating members 606 on either side of the active region 612. In preferred embodiments, the voltage difference of 20 volts provides an electric field sufficient to cause an electron emission from the emitter material 702 located on a given active region 612, whereas a voltage difference of 10 volts or 0 volts will not result in an electron emission. While the values herein are provided for example, it is understood that the voltage values may be other values or may be DC shifted, for example, the gate drive voltage may be +40 volts and the base drive voltage may be +20 volts relative to +30 volts undriven.

Figure 9:
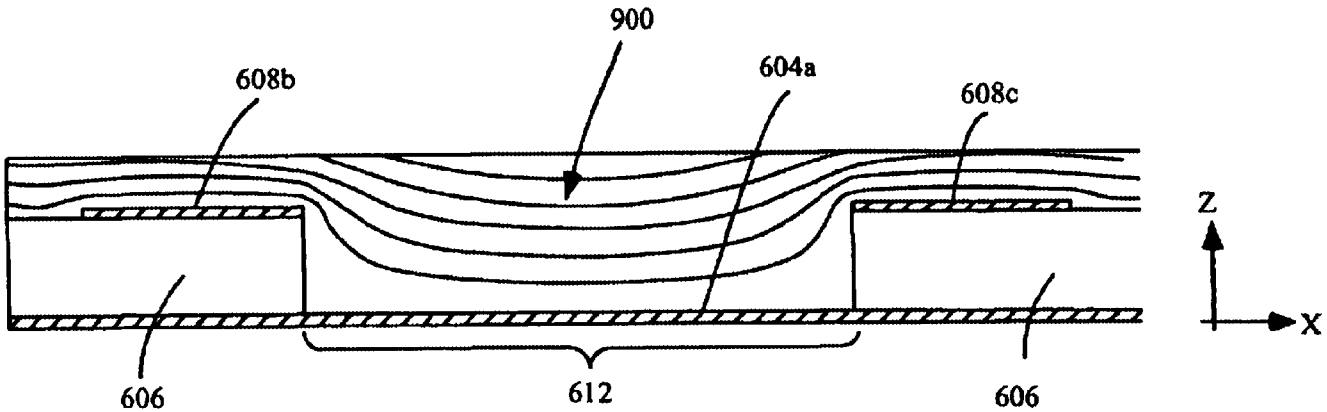
FIG. 9 is a diagram of the potential contour lines of the electric field across an active region of the base electrode when the active region is in an off state.
Figure 10:
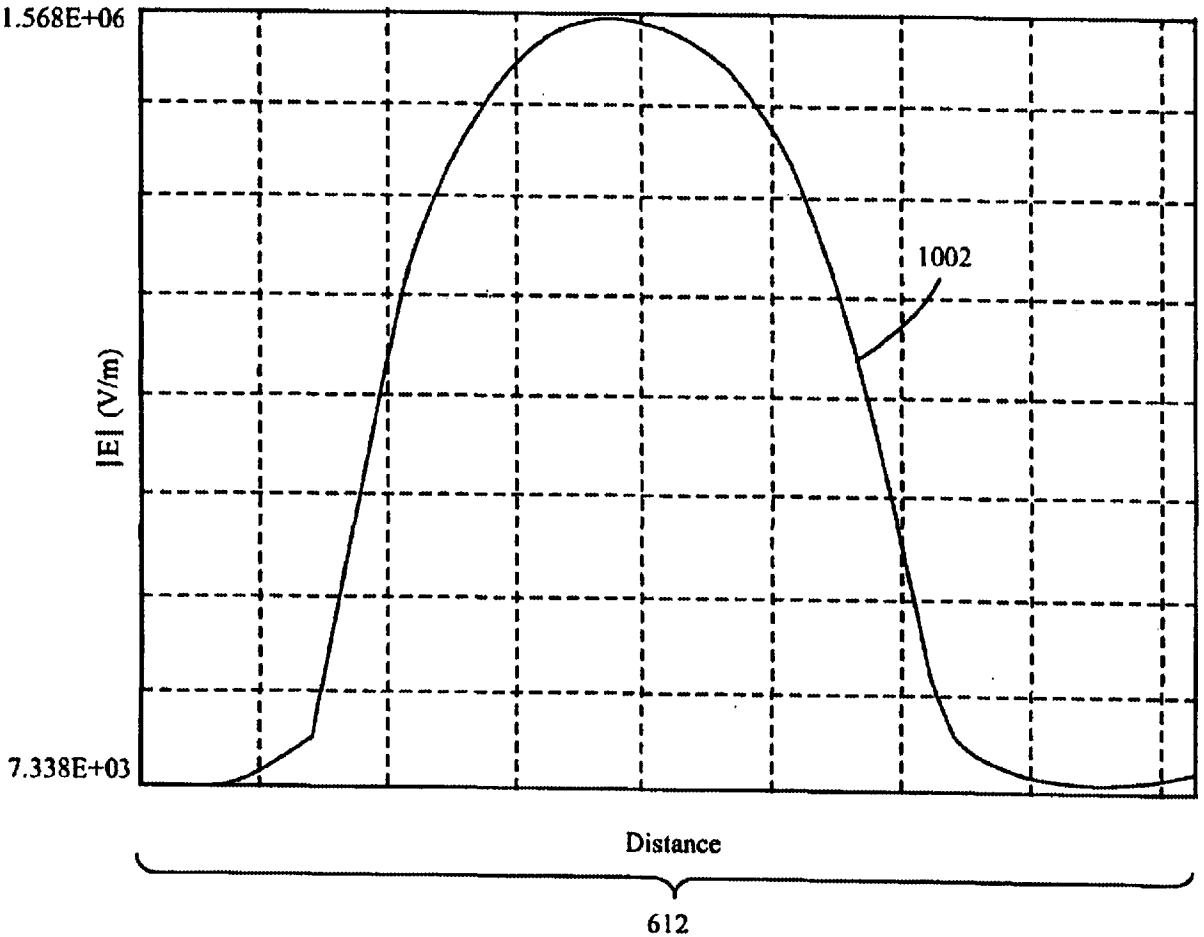
FIG. 10 is a graph of the electric field vs. distance across the active region taken at the surface of the active region in the off state of FIG. 9.

FIG. 9 illustrates the potential contour lines 900 generated above an active region when the base electrode is off or in the "off-state", i.e., there is no electron emission from the active region 612. For example, the voltage difference between the base electrode 604*a* and corresponding gate electrodes 608*b* and 608*c* is 0 volts. It is noted that for illustration purposes, the emitter material 702 is not illustrated in FIG. 9. As illustrated, the potential lines non-uniformly curve through the active region 612. FIG. 10 is a plot of the electric field vs. distance across the active region 612 taken at the surface of the active region in the off state of FIG. 9. According to several embodiments of the invention, an electron emission occurs when the electric field at the emitter material is greater than approximately 1.6 v/μm, e.g., 2.0 v/μm. That is, such an electric field is produced when the voltage difference between the base electrode and the gate electrodes is about 20 volts. Accordingly, as seen in FIG. 10, the electric field 1002 is minimal (i.e., 0.007338 v/μm) at the edges of the active region 612 and peaks at approximately 1.56 v/μm. Thus, even at its peak, the electric field is not sufficient to cause an electron emission from the emitter material located on the active region 612. It is noted that even though the voltage difference is 0 volts, the presence of potential lines is due primarily to the potential applied to the anode.

Figure 2:
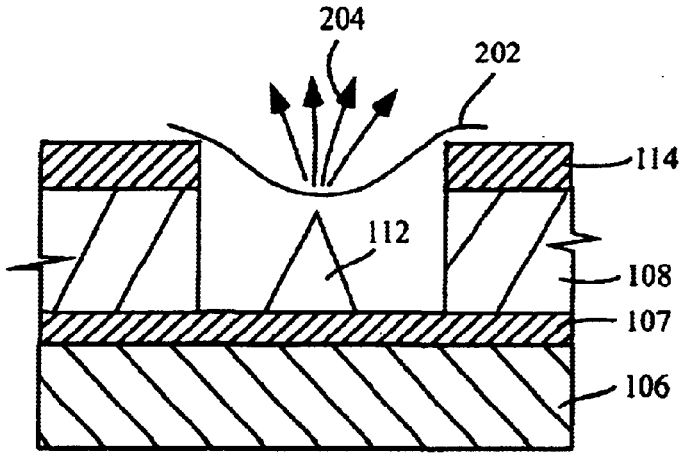
Fig. 2 (Prior Art)
FIG. 2 is a diagram of the electric field produced within a given emitter well of the conventional FED of FIG. 1.
Figure 3:
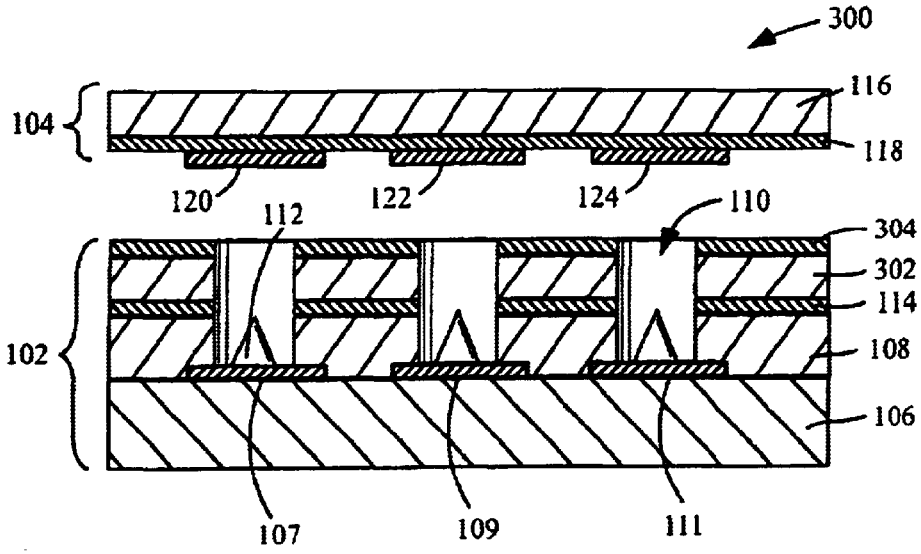
Fig. 3 (Prior Art)
FIG. 3 is a cross sectional view of a conventional FED including a focusing electrode.
Figure 4:
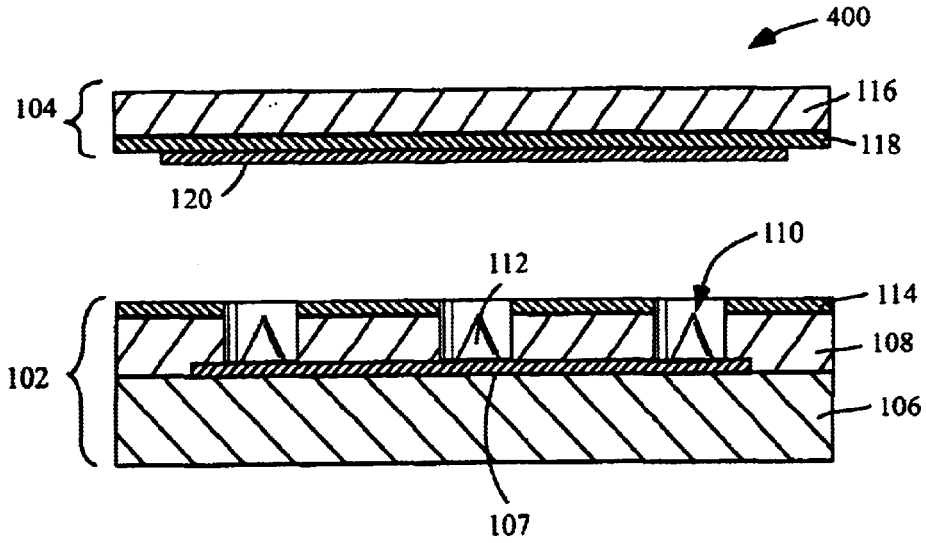
Fig. 4 (Prior Art)
FIG. 4 is a cross sectional view of another conventional FED.
Figure 5:
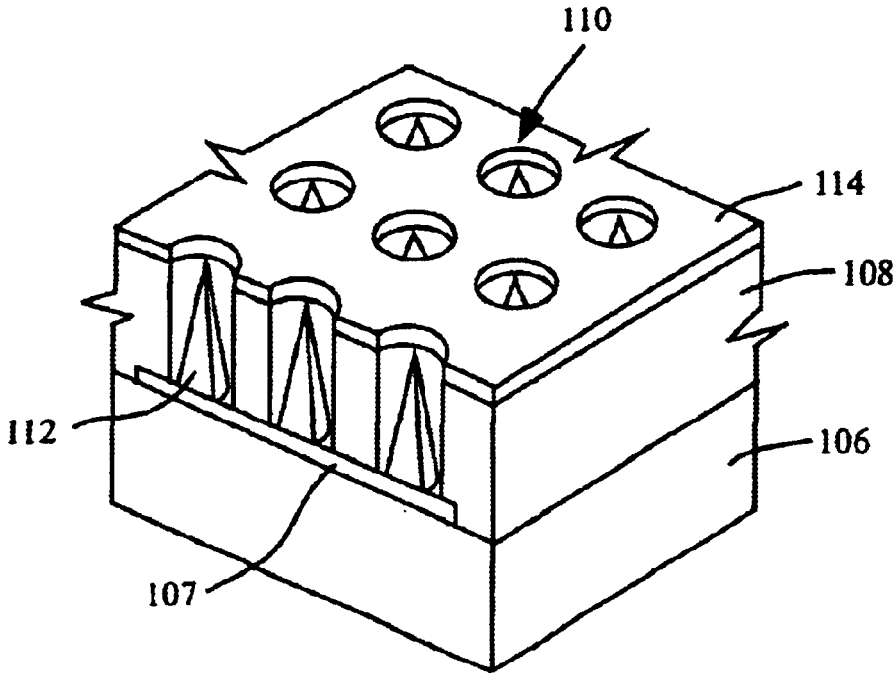
Fig. 5 (Prior Art)
FIG. 5 is a cut-away perspective view of the conventional FED of FIG. 4.
Figure 11:
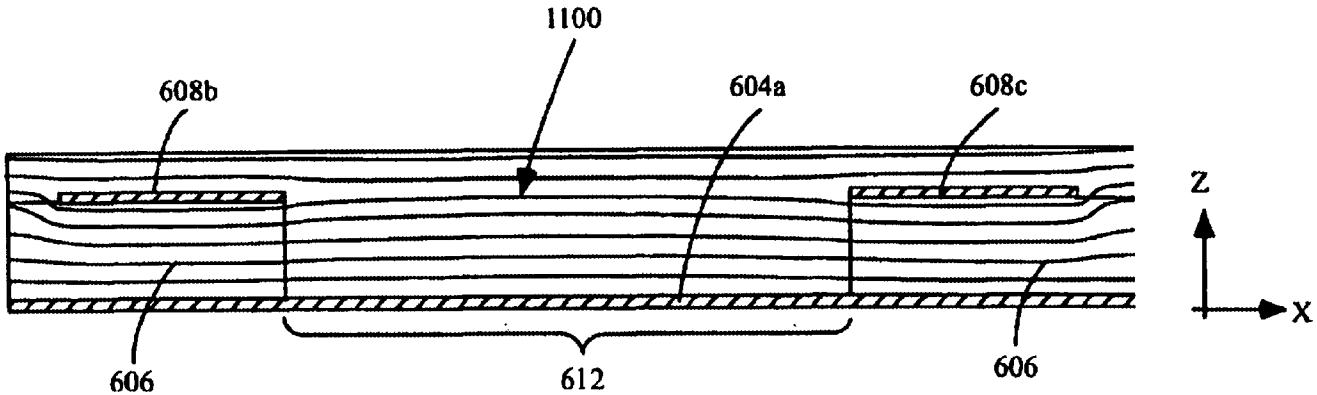
FIG. 11 is a diagram of the potential contour lines of the electric field across the active region of the base electrode when the active region is in an on state, illustrating a very uniform electric field across the active region.

FIG. 11 illustrates the potential contour lines 1100 generated above an active region when the base electrode is on or in the "on-state", i.e., there is an electron emission from the active region 612 caused by a 20 volt difference between the base electrode 604*a* and the gate electrodes 608*b* and 608*c*. It is noted that for illustration purposes, the emitter material 702 is not illustrated in FIG. 11. As illustrated, the potential lines 1100 are exceptionally uniform across the base electrode region 612, particularly close to the surface of the base electrode 604. This is in contrast to the electric field or potential lines of known FED emitter in well structures in which the potential lines are designed to focus or peak upon the tip of a given emitter as shown in FIG. 2. The substantially uniform electric field yields an electron emission that is substantially straight up from the active region with very little dispersion; thus, not requiring an additional focusing structure, e.g., no focusing electrode is required.

Figure 12:
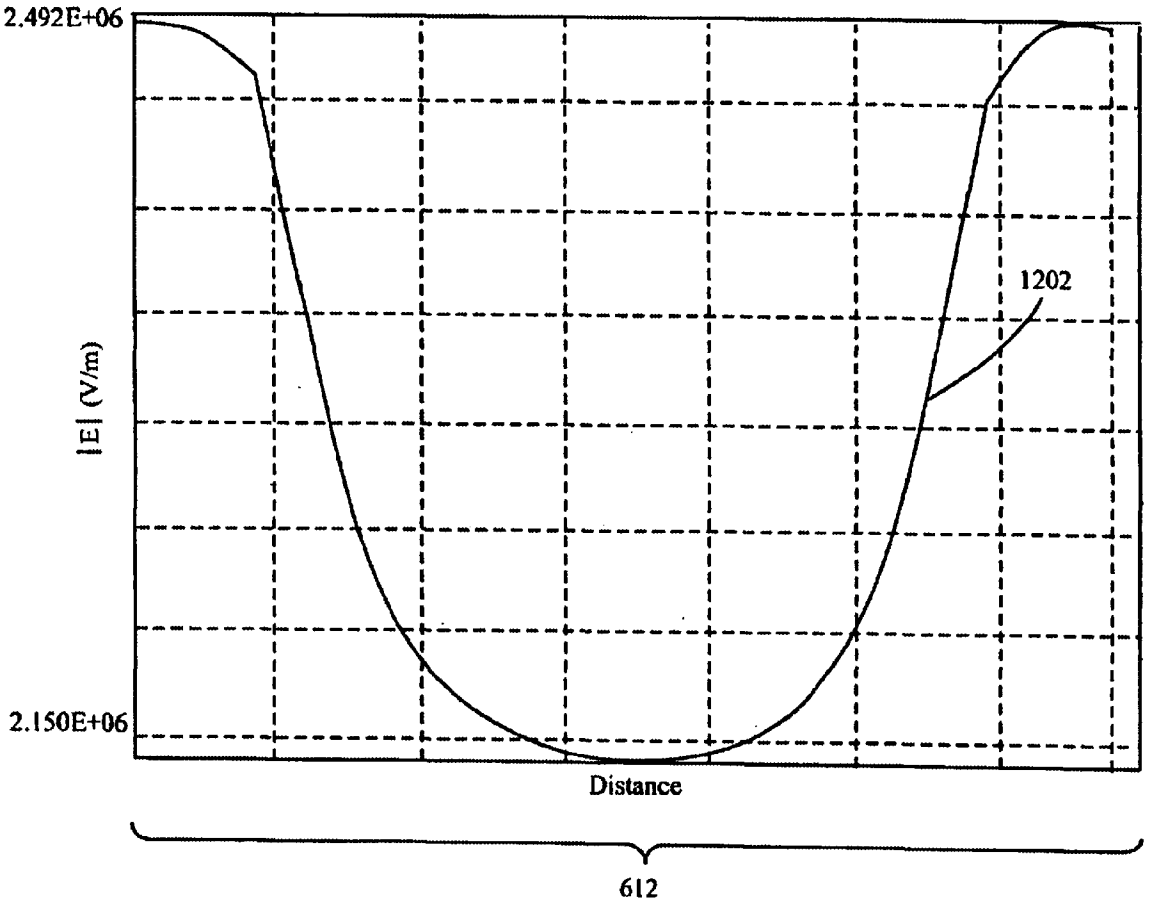
FIG. 12 is a graph of the electric field vs. distance across the active region taken at the surface of the active region in the on state of FIG. 10.

FIG. 12 is a plot of the electric field vs. distance across the active region taken at the surface of the active region 612 in the on state of FIG. 11. According to several embodiments of the invention, an electron emission occurs when the electric field at the emitter material is greater than approximately 1.6 v/μm, e.g., 2.0 v/μm. Accordingly, as seen in FIG. 12, the electric field is minimally 2.15 v/μm, which is sufficient to cause an electron material 702 located at any portion of the active region 612 to emit electrons.

Additionally, the electric field 1202 is substantially uniform across the active region 612, i.e., the electric field has a variation of only about 0.342 v/μm from the edges to the center across the entire distance of the active region 612. Within the middle 60% of the active region 612, the electric field is exceptionally uniform having a variation of only about 0.15 v/μm. Within the about middle 50% of the active region 612, the electric field is further exceptionally uniform having a variation of only about 0.15 v/μm. Again, this is contrast to known FEDs which produce an electric field that is specifically designed to be non-uniform within an emitter well. For example, a known electric field is about 100 v/μm at the tip of the emitter (e.g., a Spindt tip) and a difference of about $10^6$ v/μm between the center and edge of the emitter well.

As such, in preferred embodiments and in general terms, the substantially uniform electric field may be defined having a variation of less than 0.5 v/μm (e.g., 0.342 v/μm) across the entire active region 612, more preferably having a variation of less than 0.2 v/μm (e.g., 0.15 v/μm) across the middle 60% of the distance across the entire active region 612, and more preferably, having a variation of less than 0.1 v/μm (e.g., 0.06 v/μm) across the middle 50% of the distance across the entire active region 612.

Alternatively described, the electric field generated is substantially uniform over a relatively large distance across the active region 612. For example, the generated electric field has a variation of less than 0.2 v/μm, more preferably, less than 0.15 v/μm at the surface of the active region across a distance of the active region 612 of at least 10 μm, more preferably, at least 20 μm, and most preferably, at least 30 μm.

Figure 13:
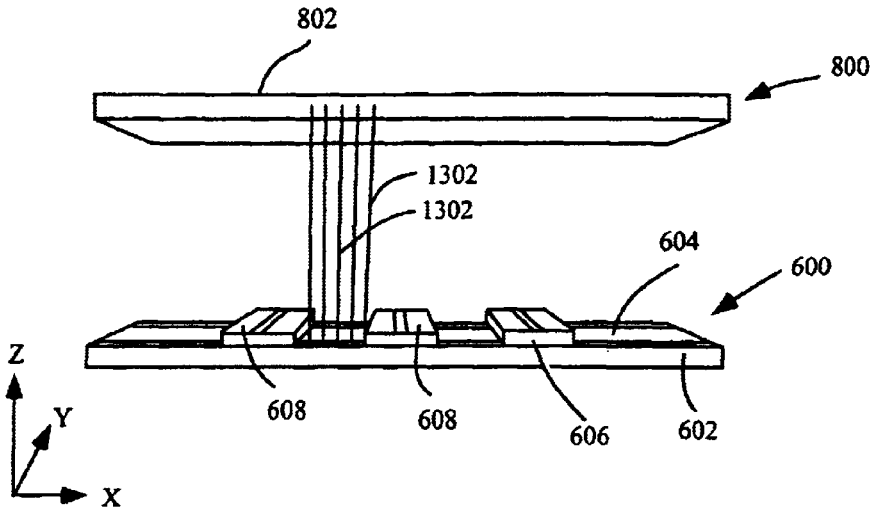
FIGS. 13 and 14 are diagrams of the electron trajectories of electron emission of the electron emitting structure, used for example, as a cathode plate of a field emission display (FED), across the width and length, respectively, of the active region illustrating very little dispersion of the electron emission, primarily due to the substantially uniform electric field.
Figure 14:
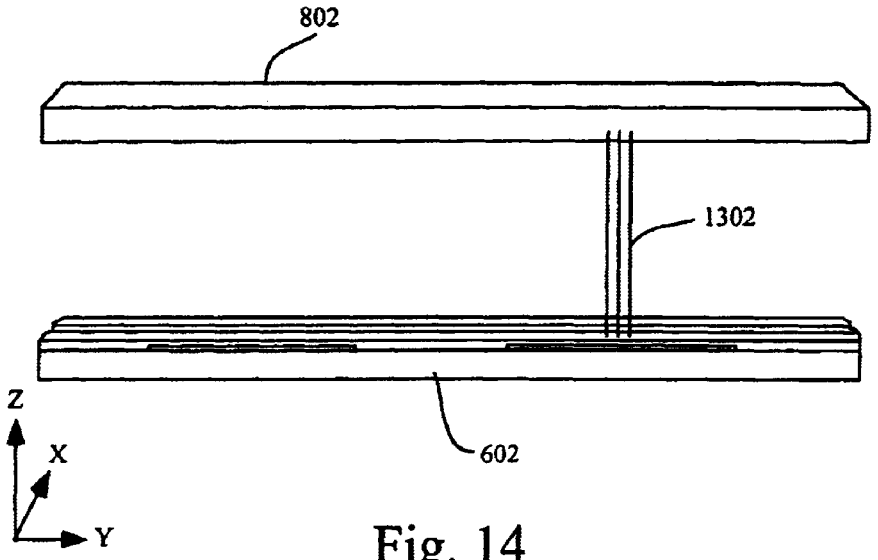

The substantially uniform electric field across the active region provides for a substantially uniform and straight electron emission that does not require additional focusing (see FIGS. 13 and 14). Additionally, combined with an emitter material that easily emits electrons, the substantially uniform electric field allows for a lower drive voltage and thus lower drive current than in conventional FEDs, for example, in preferred embodiments, the drive voltages are 10 volts, i.e., 10 volts to the base electrodes 604 and 10 volts to the gate electrodes 608 results in an electric field greater than 2 v/μm. In contrast, in order to create the electric field having the shape to sufficiently rip electrons off of the tip of a conventional emitter, a drive voltage of 20–100 volts is common such that the electric field is greater than 100 v/μm.

In preferred embodiments, to produce an electron emission that is as uniform and straight as possible, the emitting material is deposited within a central portion of the active region 612 to avoid the majority of the non-uniformity in the electric field at the edges of the active region as illustrated in FIG. 12. For example, the emitting material covers the middle 50–99%, more preferably the middle 55–90%, and most preferably the middle 60–80% of the active region 612.

FIGS. 13 and 14 illustrates the electron trajectories of the electron emission 1302 produced by the electron emitting structure of FIG. 6 across the width (x-direction) and the length (y-direction), respectively of the active region. As clearly seen, the electron emission has very little dispersion due to the substantially uniform electric field across the active region, i.e., the electron emission from the active region projects substantially straight toward a corresponding anode sub-pixel region (phosphor) of the anode plate 800 thereabove. Thus, additional focusing structures are not required. This is a departure from known FEDs, which use separate focusing grids (see the focusing electrode 304 of FIG. 3) that are distinct from the conventional gate electrode.

Figure 15:
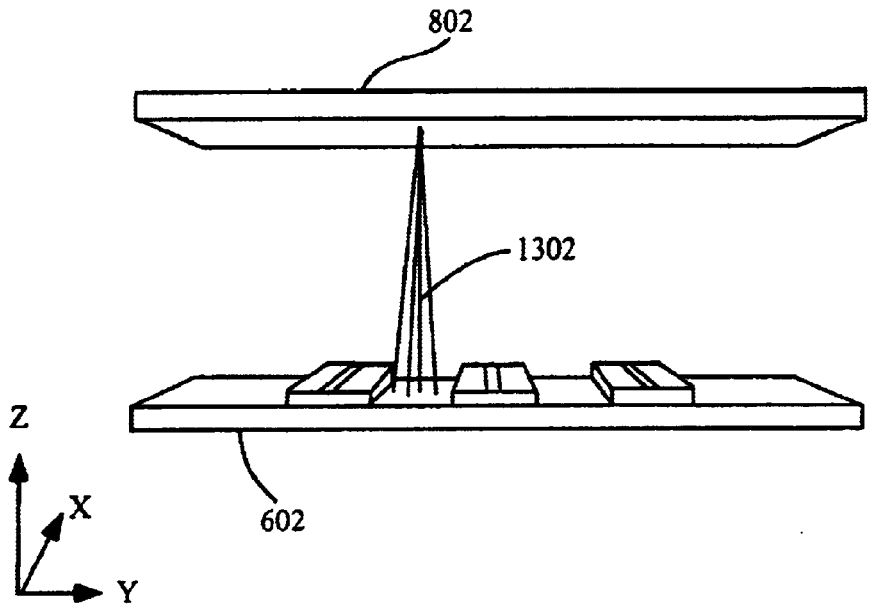
FIG. 15 is a diagram of the electron trajectories of FIG. 13 when underdriving the gate electrode voltage in order to focus an electron emission across the width of the active region in accordance with one embodiment of the invention.
Figure 16:
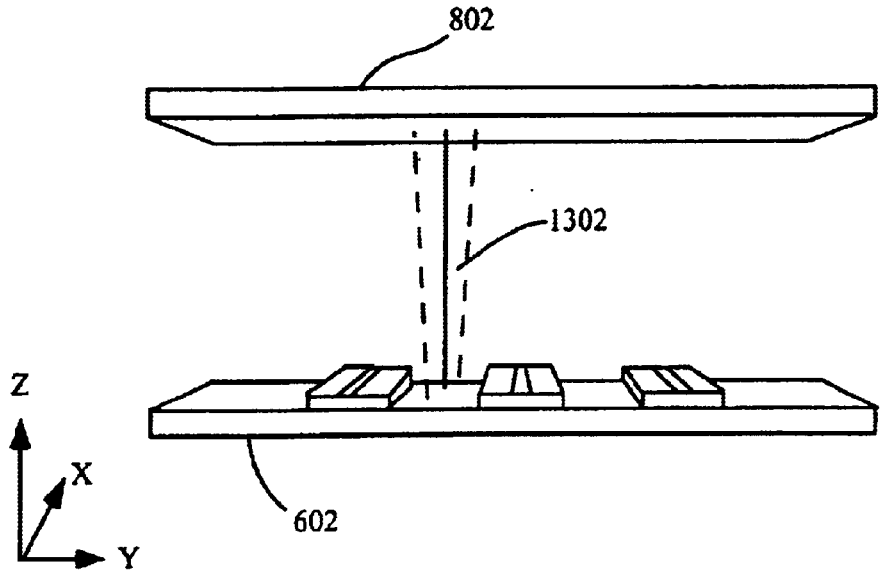
FIG. 16 is a diagram of the electron trajectories of FIG. 13 when overdriving the gate electrode to spread an electron emission across the width of the active region in accordance with one embodiment of the invention.

However, in some embodiments, depending on the emitter material selected, the electron emission may still spread or converge the electrons slightly. For example, when nanotubes are deposited on the active region 612, and after being activated (i.e., the nanotubes are made to stand up), some of the nanotubes may be naturally oriented having a slight side momentum such that the resulting electron emission may spread slightly or are oriented slightly inward such that the resulting electron emission may converge slightly. To counter this slight spreading or converging, the structure may be underdriven (FIG. 15) or overdriven (FIG. 16). That is, as illustrated in FIG. 15, the voltage potential to a pair of the gate electrodes 608 that will activate a given active region is driven lower than otherwise, which causes a slight focusing of the resulting electron emission in between the two gate electrodes, e.g., across the width of the active region (the x-direction). Similarly, as illustrated in FIG. 16, the voltage potential to a pair of the gate electrodes 608 that will activate a given active region is driven higher than otherwise, which causes a slight spreading of the resulting electron emission in between the two gate electrodes, e.g., across the width of the active region (the x-direction). It is noted, however, that underdriving and overdriving the electron emitting structure as configured in the embodiment of FIG. 6, results in a focusing in the x-direction and does not result in a focusing of the electron emission in the y-direction.

Advantageously, by underdriving and overdriving the electron emitting structure, for example, by adjusting the drive voltage to the gate electrodes 608, the electron emission may be focused as desired. This is accomplished without the use of an additional focusing structure (such as the focusing electrode 304 of FIG. 3). Furthermore, in this embodiment, the same components that function as the gate electrode are also used to focus or reduce electron spread, rather than a separate discrete focusing grid or electrode.

Additionally, in embodiments that employ underdriving and overdriving, it is preferred that pulse width modulation techniques as well known in the art are applied in order to ensure consistent spot size on the anode. For example, pulse width modulation varies the duration that a given active region (and thus, a corresponding anode sub-pixel region or "spot") is turned on in order to vary the appearance of the size and brightness of the spot.

Figure 17:
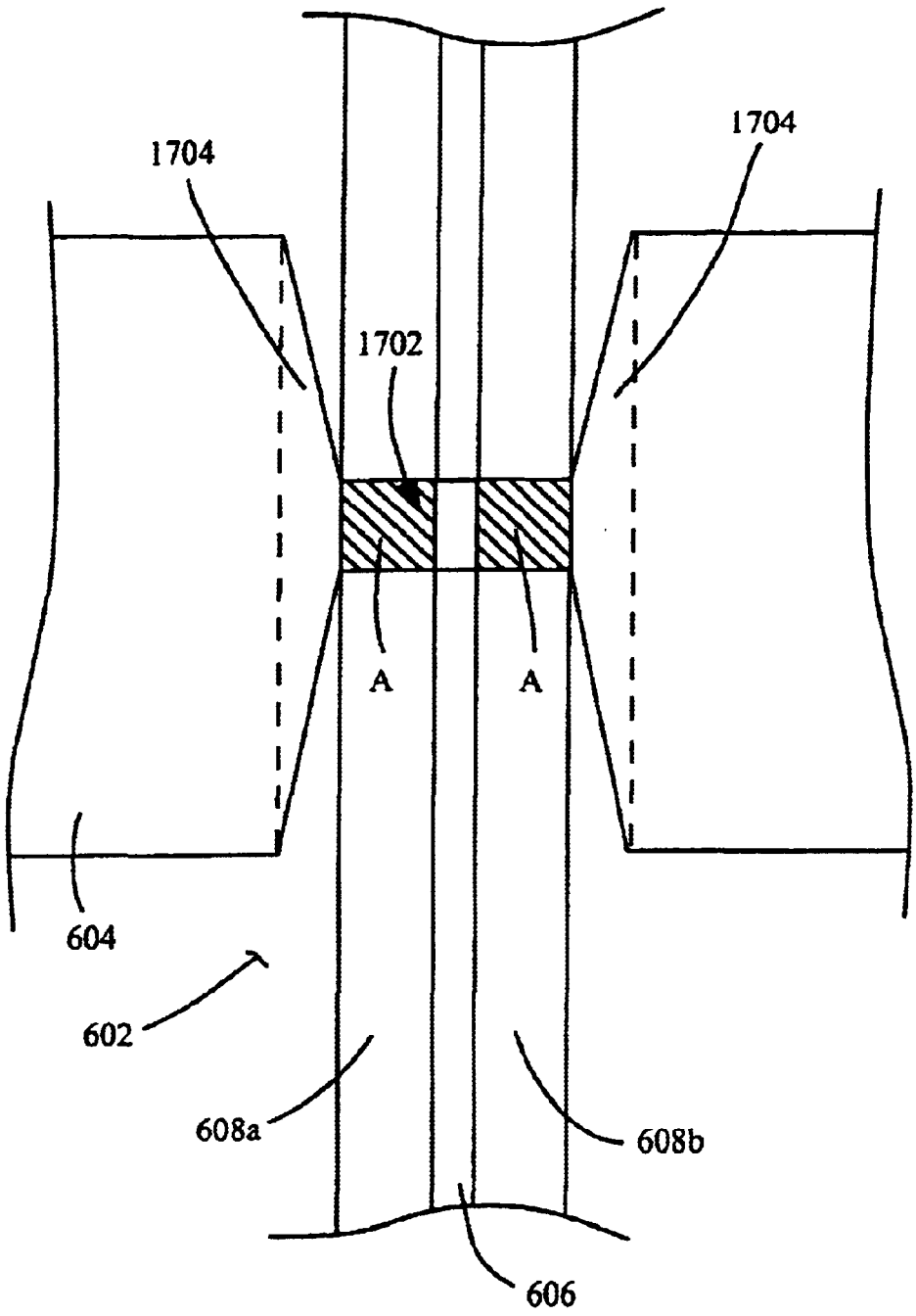
FIG. 17 is a schematic view of a base electrode in which the area of the base electrode underneath an insulating member and its gate electrodes is reduced according to one embodiment in order to lower the capacitance formed between the gate and the base.

Referring next to FIG. 17, a schematic view of a base electrode in which the area of the base electrode underneath the insulating member 606 and respective gate electrodes 608 is reduced according to one embodiment in order to lower the capacitance formed between the gate electrode and the base electrode. Illustrated is the base electrode 604 above which is formed the insulating layer 606 and the gate electrodes 608. However, the region of each gate electrode 608 that passes over the base electrode and the underlying and overlapping region of the base electrode function as a parallel plate capacitor having a capacitance. The capacitance C may be determined as follows:

$$C = \frac{Ke_0A}{d} \qquad \text{Eq. (1)}$$

where K is the dielectric constant of the insulating material, eo is the permeativity of the vacuum within the FED, A is the area of the overlapping interface between the base electrode 604 and the gate electrode 608 and d is the distance or separation between the base electrode 604 and the gate electrode 608. It is noted that the capacitance developed between two adjacent gate electrodes formed on a given insulating member, e.g., gate electrodes 608*a* and 608*b*, is negligible.

According to several embodiments, in order to lower the capacitance formed between the base electrode 604 and a gate electrode 608, the area of overlapping portions of the base electrode 604 and the gate electrode 608 is reduced. For example, as illustrated in FIG. 17, the portion of the base electrode that an insulating member and gate electrodes will be formed over is printed to taper inward to a narrow bridge portion 1702 extending underneath the insulating member, then taper back outward to the full width of the base electrode. That is, the width of the bridge portion 1702 is narrower than the width of the base electrode 604 generally. Thus, the base electrode 604 is at its full width at the active regions and is significantly narrowed to a bridge section 1702 underneath respective insulating members 606. As is clearly seen, this results in a significant reduction in the area A of the base electrode and gate electrode interface; thus, the resulting capacitance C is significantly reduced without affecting the electric field in the active regions 612. Preferably, the area A is reduced by at least 50%, more preferably at least 60%, and most preferably by at least 70% in comparison to a non-reduced base electrode 604. The manufacture of such base electrodes narrowing to bridge portions 1702 underneath respective insulating members 606 may be easily accomplished using existing screen printing or sputtering techniques. It is noted that alternatively, the distance d could be increased (by increasing the thickness of the dielectric members 606) to reduce the capacitance; however, such adjustment would alter the electric field generated at the surface of the active region. It is also noted that alternatively, the width of the gate electrode 608 could be reduced; however, this may also affect the electric field generated at the surface of the active region.

It is noted that taper portions 1704 connect the bridge portion 1702 to the active region 612 of the base electrode. As illustrated, the taper portions 1704 start at the edge of the insulating member. It is understood that such taper portions 1704 may be underneath the insulating member; however, this increases the area of the intersecting or overlapping base electrode. Since the emitter material 702 is preferably not deposited out to the edges of the active region, the illustrated embodiment is preferred. Additionally, it is noted that one skilled in the art may alter the specific geometry of the bridge portion 1702 or gate electrodes in order to reduce the overlapping or intersecting area A in a variety of ways without departing from the scope of this embodiment of the invention.

Figure 18:
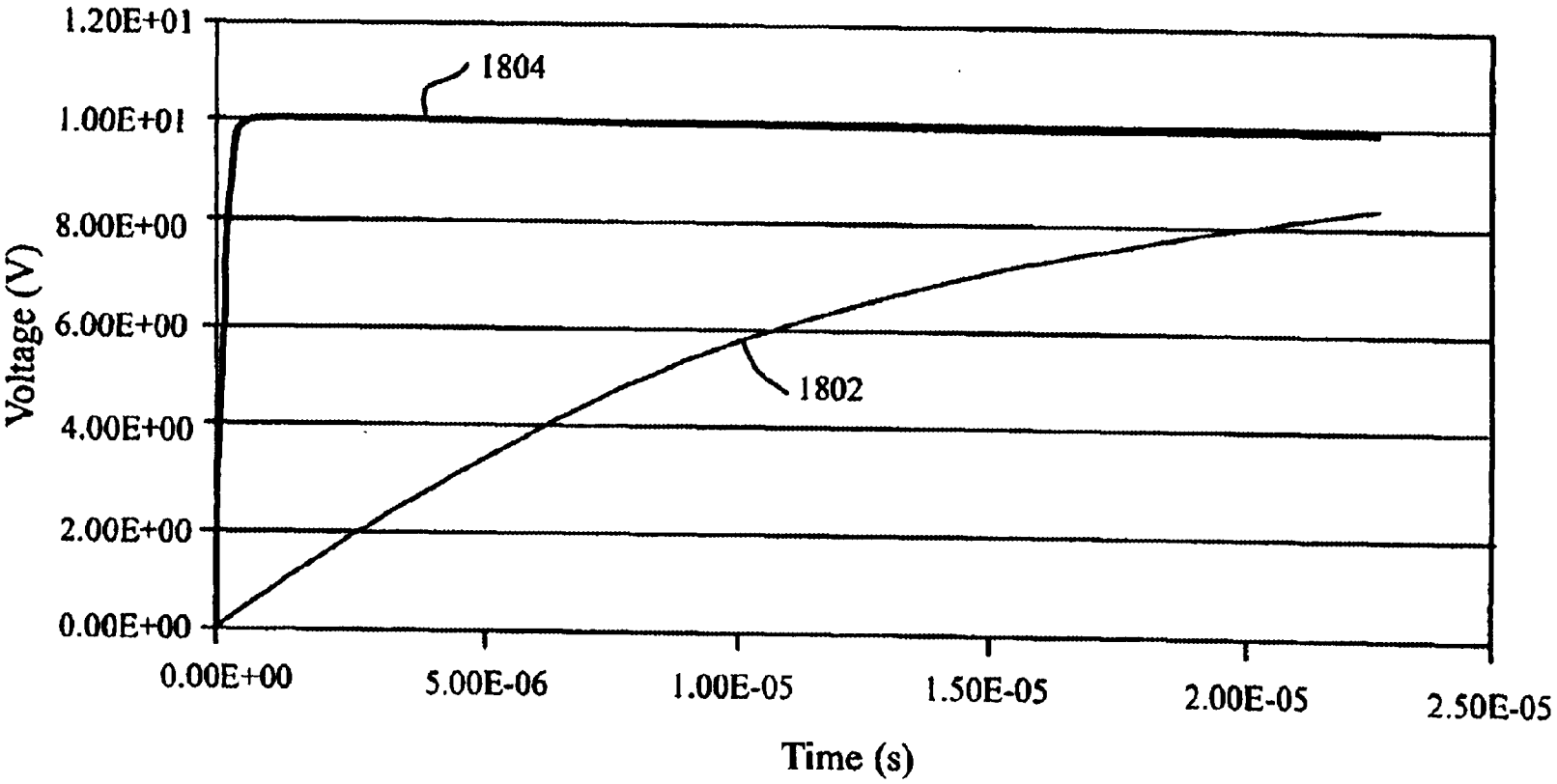
FIG. 18 is a graph of the transient time to charge a given base electrode and gate electrodes of an electron emitting structure using the base electrode of FIG. 17.

Advantageously, the lower capacitance improves the drive characteristics and allows for more flexibility in the electron emitting structure or cathode design. For example, since the capacitance is lowered, less power is required to charge the base electrode 604 and the gate electrodes 608. That is, since the time constant is lowered, these lines may be charged faster. FIG. 18 is a graph of the transient time to charge a given base electrode 604 and corresponding gate electrodes 608 to their driving potentials using the base electrode of FIG. 17 having a narrow bridge portion 1702 in comparison to the transient time to charge a base electrode of a traditional FED using an emitter in well structure which has significantly higher capacitance formed between the base and the gate electrodes. Curve 1802 shows that after 25.0 $\mu$sec, the electrode is not fully charged to 10 volts (i.e., the pixel has not turned on), while the base electrode with the reduced area is fully charged (i.e., the pixel is on) after less than 1.0 $\mu$sec shown by curve 1804. If, for example, base electrodes for 1000 pixels were to be charged, the refresh rate would have to set so that the electrodes (lines) could be charged (i.e., all the pixels could be turned on) or else, electrodes (lines) would be skipped (i.e., some pixels might not be turned on). Thus, according to this embodiment, the refresh frequency may be increased. Alternatively, more pixels may be added to the display for higher resolution, since more pixels may be turned on in less time. Furthermore, by taking less time to turn on a given pixel, the brightness of the device is improved, since pixels are left on longer before between refreshing.

This also enables the manufacture and successful driving of larger sized FEDs. For example, the largest conventional FEDs are about 13 inches. Typically, with display sizes of less than 13 inches, the charging time is not an issue in FEDs. However, the larger the display size, the larger the pixel size and thus the intersecting area of a base electrode and the gate electrode material (e.g., circumscribing emitter wells), which would again increase the capacitance and thus lower the charging time for a given base electrode. Thus, the charging time may exceed an acceptable refresh rate. However, by reducing the overlapping area of the base electrode 604 and the gate electrode structure (e.g., gate electrode 608), as illustrated in FIG. 17, drivable FEDs may be made in accordance with the invention that are 21 inches or greater that may be driven at a refresh rate of 80 kHz.

Additionally, according to several embodiments of the invention, the electron emitting structure reduces the problem of crosstalk in an FED. For example, crosstalk occurs when electrons are unintentionally emitted from active regions (e.g., sub-pixels) adjacent to active regions (e.g., sub-pixels) that are intended to emit electrons. Crosstalk leads to a poor contrast ratio in the resulting display.

Figure 19:
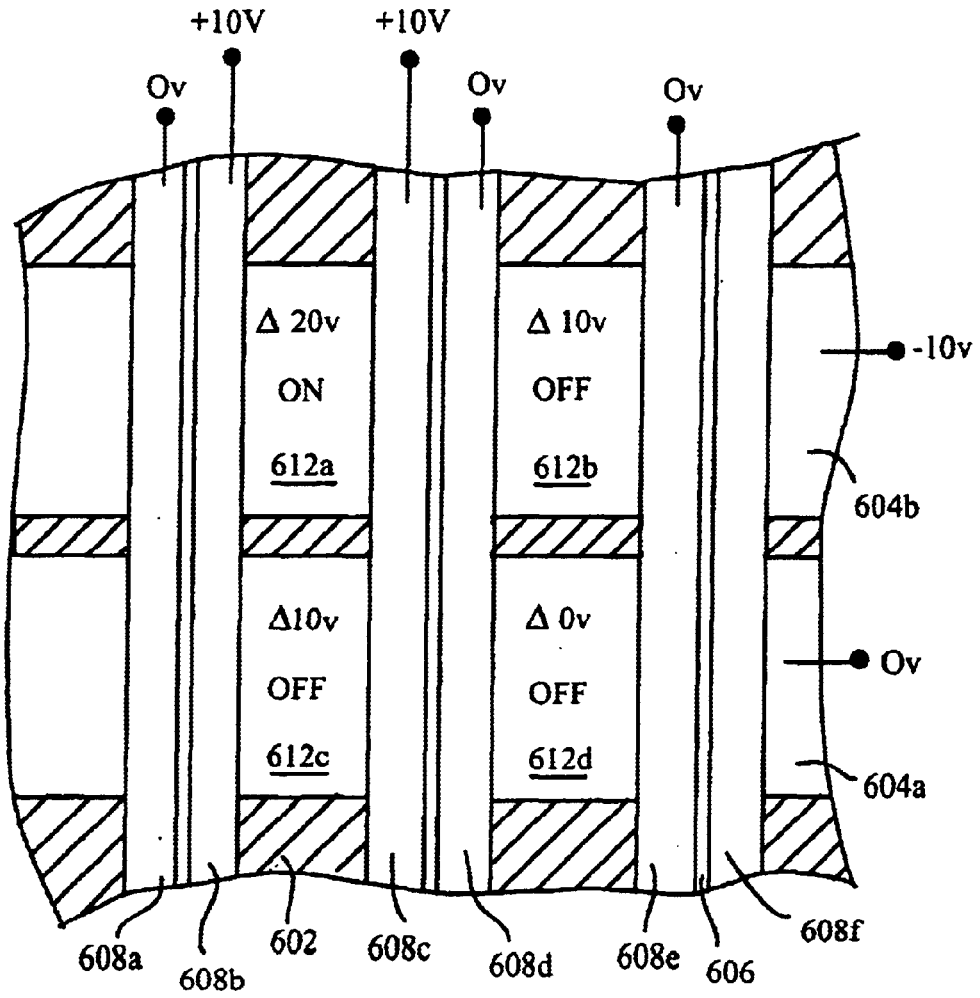
FIG. 19 is a diagram illustrating the driving of a given active region and its effect on adjacent active regions according to one embodiment of the invention.

As illustrated in FIG. 19 and according to one embodiment, a voltage differential of about 20 volts between a given base electrode 604 the adjacent gate electrodes 608 on adjacent insulating members 606 is required to fully turn an active region 612 on, i.e., turn on a sub-pixel. Thus, the base drive voltage $V_B$ and the gate drive voltage $V_G$ are each set to 10 volts (having opposite polarity). A threshold voltage $V_{TH}$ is set at 10 volts, such that above a 10 volt difference between the base electrode and the gate electrodes, electrons may be emitted from an emitter material located at a given active region, i.e., if the voltage difference is greater than 10 volts, then the electric field at the emitter material may be greater than 2.0 volts/micron. However, it is noted that while a difference of 10 volts may causes some electron emission, it is not enough to fully turn on the given active region (e.g., sub-pixel region). Furthermore, the crosstalk voltage $V_{CT}$ is at 10 volts, such that crosstalk may occur if the voltage differential at an adjacent active region is greater than 10 volts.

As seen in FIG. 19, if a given active region 612*a* is to be turned on, −10 volts is applied to base electrode 604*b* and +10 volts is applied to the gate electrodes adjacent to the active region, e.g., gate electrodes 608*b* and 608*c*. As seen, the voltage difference at active region 612*a* is 20 volts; thus, active region 612*a* is fully turned on (i.e., electrons are emitted from an emitter material located on the active region 612*a*). The voltage difference at adjacent active regions 612*b* and 612*c* is 10 volts; thus, these active regions 612*b* and 612*c* are off (i.e., no electrons are emitted). Likewise, the voltage difference at adjacent active region 612*d* is 0 volts; thus, active region 612*d* is off. Advantageously, since the threshold voltage is equal to the crosstalk voltage ($V_{TH}$=$V_{CT}$=10 volts), then the voltage difference at any adjacent active region is never enough to cause an electron emission; thus, crosstalk is not problematic according to many embodiments of the invention.

Referring next to FIG. 20, an alternative embodiment is shown of the electron emitting structure of FIG. 6. In this embodiment, each active region 612 is bounded on sides by an insulating material. That is, the insulating material includes members 606 extend linearly across the base electrodes 604 and include portions 607 that extend linearly in between the base electrodes 604. In this alternative embodiment, the active region 612 is still defined by gate electrodes 608 on either side thereof. It is noted that in this embodiment, the dielectric material, i.e., the insulating members 606 and the insulating portions 607 resemble large rectangular trenches 2002 defining the edges of the active region 612. However, in contrast to the emitter in well structure of known FEDs, these trenches 2002 are considerably larger than the conventional well. For example, in one embodiment, the trenches 2002 are sized to be at least 2×2 $\mu$m, preferably at least 10×10 $\mu$m, and most preferably at least 20×20 $\mu$m, e.g., in one embodiment, the trench 2002 is 50×250 $\mu$m. The larger trench area allows for two or more discrete electron emitting portions (e.g., tips, nanotubes, etc.) to be deposited thereon, the two or more portions not separated from each other by dielectric material, a thin electron emitting film, or a continuously applied electron emitter material to be deposited thereon. Advantageously, the additional insulating portions 607 do not affect the electric field produced within the active region or the resulting electron emission, since there is not corresponding gate electrode material formed thereon.

Figure 21:
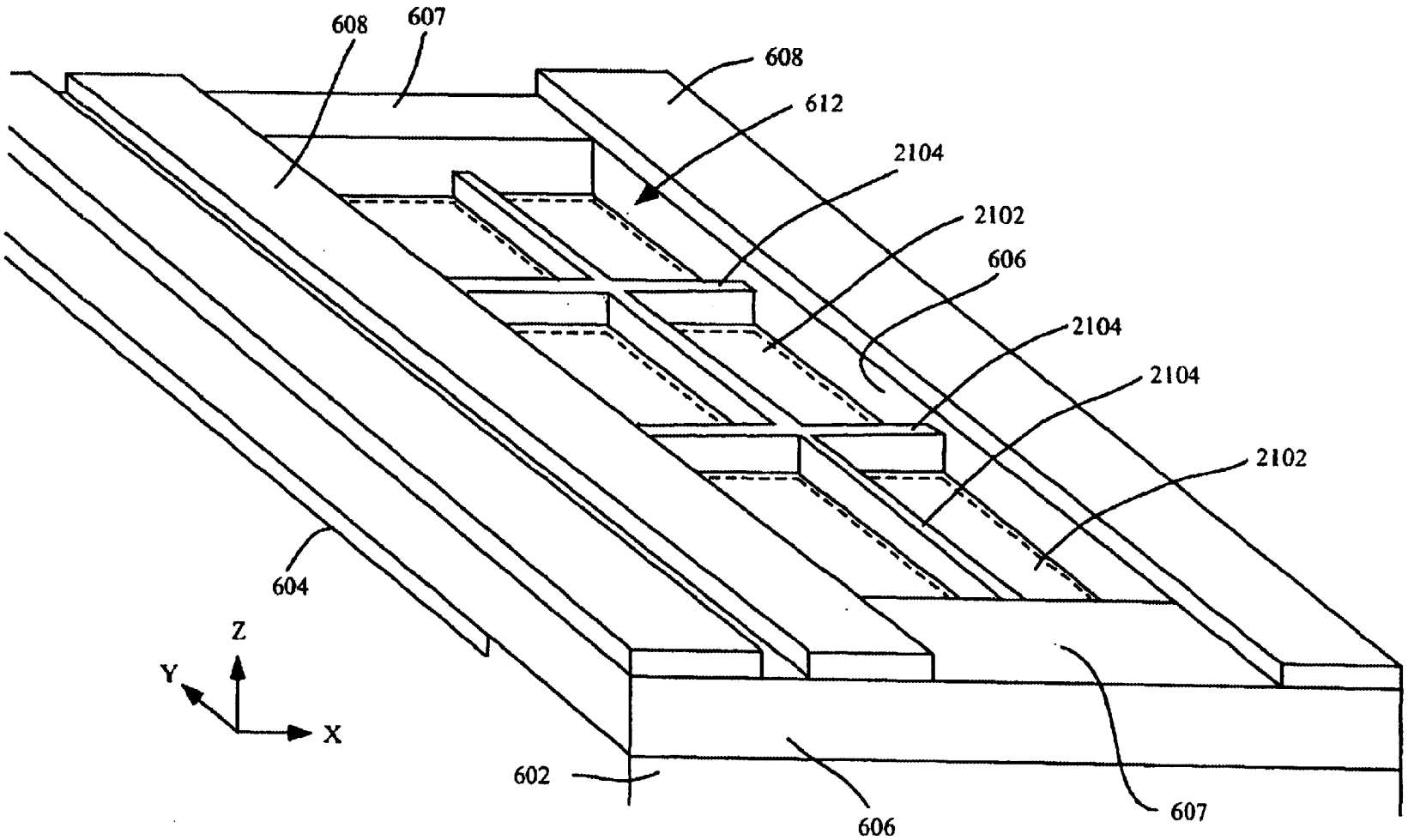
FIG. 21 is an alternative embodiment of the electron emitting structure of FIG. 20 in which the active regions are sub-divided by insulating material into smaller portions.

Referring next to FIG. 21, an alternative embodiment of the electron emitting structure of FIG. 20 is shown. In this embodiment, the active regions are sub-divided by insulating material into smaller portions 2102. For example, one or more ribs 2104 of dielectric or insulating material extend over the active region 612 between opposite insulating members 606 and opposite insulating portions 607. Each active region is still defined generally by the gate electrodes 608 on either side. Additionally, in contrast to the known emitter in well structure, the sub-divided portions 2102 of the active region and still configured to be large enough to allow two or more discrete electron emitting portions (e.g., tips, nanotubes, etc.) to be deposited thereon, the two or more portions not separated from each other by dielectric material, a thin electron emitting film, or a continuously applied electron emitter material to be deposited thereon. The sub-divided portions 2102 are still sized larger than wells of the conventional FEDs such that at least 2 emitter portions, a thin film or a continuous emitter material may be deposited thereon. Again, the additional ribs 2104 do not affect the electric field produced within the active region or the resulting electron emission since gate electrode material is not formed on the sub-divided portions 2102.

In one implementation, the electron emitting structure 600 according to several embodiments of the invention is used as a cathode to make a large FED type display, such as greater than 13 inches. By utilizing the base electrode/gate electrode construction combined with the reduced base electrode area intersecting with gate electrodes extending thereover, large FED displays are possible. Additionally, such a large FED cathode plate may be implemented in a spacerless FED, such as described in U.S. patent application Ser. No. 10/306,172, of Russ, et al., entitled SPACER-LESS FIELD EMISSION DISPLAY, filed Nov. 27, 2002, and which is incorporated herein by reference. As described, by increasing the thickness of the faceplate (e.g., transparent substrate 802), an FED may be made without requiring spacers to maintain the uniform separation between the electron emitting structure or cathode plate and the anode in the pressure of the vacuum. Advantageously, an electron emitting structure according to several embodiments described herein enables a drivable FED greater than 13 inches, for example, as much as 21 or 35 inches. Such an FED could be used to implement a high resolution, large screen, relatively thin FED-based television having CRT like performance without CRT thickness. Such large screen FED-based televisions would have a thickness comparable to existing liquid crystal display (LCD) and plasma display televisions.

In another alternative use, the electron emitting structure is used as a field ionizer, rather than an emitter. For example, as is known, the gate electrode drive voltage is made negative with respect to the base electrode drive voltage. Additionally, the electron emitting structures described herein may be implemented as field emission displays (FEDs) or any other application requiring an electron emission, such as an imaging device (X-ray device).

While the invention herein disclosed has been described by means of specific embodiments and applications thereof, numerous modifications and variations could be made thereto by those skilled in the art without departing from the scope of the invention set forth in the claims.

What is claimed is:

1. An electron emitting structure comprising:

a substrate;

base electrodes formed on the substrate;

gate electrodes formed in groups of two above and crossing over the base electrodes;

insulating material formed on the substrate and the base electrodes separates the gate electrodes from portions of the base electrodes, the gate electrodes formed on the insulating material; and an electron emitting material deposited on active regions of the base electrodes, each active region defined as a portion of each base electrode between a respective pair of gate electrodes.

2. The structure of claim 1 wherein the electron emitting material comprises a plurality of electron emitting portions deposited on each active region.

3. The structure of claim 2 wherein individual ones of the plurality of electron emitting portions are not separated from each other by the insulating material.

4. The structure of claim 2 wherein the plurality of electron emitting portions are selected from a group consisting of: tips, cones, pyramids and nanotubes.

5. The structure of claim 1 wherein the electron emitting material comprises a continuous electron emitting material deposited as a layer or film on each active region.

6. The structure of claim 1 wherein the electron emitting material is deposited to cover less than an entire portion of each active region.

7. The structure of claim 1 wherein the electron emitting material is not deposited at periphery edges of each active region.

8. The structure of claim 1 wherein upon applying a first voltage potential to a base electrode and applying a second voltage potential to the respective pair of gate electrodes, an electric field is produced in the respective active region sufficient to cause an electron emission from a respective electron emitting material deposited on the respective active region.

9. The structure of claim 8 wherein the electric field is substantially uniform across the respective active region.

10. The structure of claim 9 wherein the electron emission is substantially straight up from the respective active region without the use of a separate focusing structure.

11. The structure of claim 9 wherein a variation of the electric field at a surface of each active region across the active region is less than 0.5 v/$\mu$m.

12. The structure of claim 9 wherein a variation of the electric field at a surface of each active region across a distance of at least 10 $\mu$m across the active region is less than 0.2 v/$\mu$m.

13. The structure of claim 1 wherein each base electrode has a first width at the active regions and narrows to a bridge portion having a second width connecting the active regions of the base electrode, the second width less than the first width, each bridge portion separated from a respective gate electrode by a portion of the insulating material, each bridge portion reducing a capacitance generated between each base electrode and the respective gate electrode.

14. The structure of claim 1 wherein a time to fully charge an active region is less than 0.1 $\mu$sec.

15. The structure of claim 1 wherein the insulating material comprises insulating members extending linearly across the substrate and the base electrodes, the active regions also defined between adjacent insulating members.

16. The structure of claim 15 wherein the insulating members include continuous portions extending in between adjacent base electrodes connecting adjacent insulating members.

17. The structure of claim 15 wherein two gate electrodes extend in parallel on at least a portion of each insulating member.

18. The structure of claim 17 wherein one of the two gate electrodes comprises one of the respective pair of gate electrodes defining an active region.

19. A method of electron emission comprising:

applying a first potential to a one of a plurality of base electrodes formed on a substrate of an electron emitting structure;

applying a second potential to each of a pair of gate electrodes crossing over the one of the plurality of base electrodes, the pair of gate electrodes each separated from the base electrode by an insulating material formed on a portion of the base electrode and the substrate, the gate electrodes formed in groups of two on the insulating material; and producing an electric field across an active region of the one of the plurality of base electrodes as a result of the applying the first potential and the applying the second potential, the electric field sufficient to cause an electron emission from an electron emitting material located on the active region of the one of the plurality of base electrodes, the active region defined as a portion of the base electrode between the pair of gate electrodes.

20. The method of claim 19 wherein the producing step comprises producing a substantially uniform electric field across the active region.

21. The method of claim 20 wherein the producing step further comprises producing the substantially uniform electric field to cause a substantially straight electron emission from the electron emitting material without the use of a separate focusing structure.

22. The method of claim 20 wherein the producing step further comprises producing the substantially uniform electric field across the active region, the electric field having a variation of less than 0.5 v/$\mu$m at a surface of the active region across the active region.

23. The method of claim 20 wherein the producing step further comprises producing the substantially uniform electric field across the active region, the electric field having a variation of less than 0.2 v/$\mu$m at a surface of the active region across a distance of at least 10 $\mu$m across the active region.

24. The method of claim 19 wherein producing step comprises producing the electron emission to cause the electron emission from the electron emitting material comprising a plurality of electron emitting portions deposited on the active region.

25. The method of claim 19 wherein producing step comprises producing the electron emission to cause the electron emission from the electron emitting material comprising a continuous electron emitting material deposited as a layer or film on the active region.

26. The method of claim 19 wherein the applying the second potential step comprises applying the second potential to each of the pair of gate electrodes, the second potential less than a nominal gate drive potential in order to underdrive the active region to focus the electron emission.

27. The method of claim 19 wherein the applying the second potential step comprises applying the second potential to each of the pair of gate electrodes, the second potential greater than a nominal gate drive potential in order to overdrive the active region to spread the electron emission.

28. The method of claim 19 wherein the steps of applying the first potential and the second potential result in the steps of charging the base electrode to the first potential and charging each of the gate electrodes to the second potential, the charging steps occurring in less than 0.1 $\mu$sec.

29. A field emission display comprising:

a cathode plate comprising:

a substrate;

base electrodes formed on the substrate, the base electrodes functioning as cathodes;

gate electrodes formed in groups of two above and crossing over the base electrodes;

insulating material formed on the substrate and portions of the base electrodes separates the gate electrodes from the base electrodes and electrically insulates the base electrodes from the gate electrodes, the gate electrodes formed on the insulating material; and an electron emitting material deposited on active sub-pixel regions of the base electrodes, each active sub-pixel region defined as a portion of each base electrode between a respective pair of gate electrodes;

an anode plate comprising:

a transparent substrate separated above the substrate; and phosphor material coupled to the transparent substrate, portions of the phosphor material corresponding to active sub-pixel regions of the base electrodes.

30. The display of claim 29 wherein upon applying a first voltage potential to a base electrode and applying a second voltage potential to the respective pair of gate electrodes, an electric field is produced in a respective active sub-pixel region sufficient to cause an electron emission from a respective electron emitting material deposited on the respective active sub-pixel region.

31. The display of claim 29 wherein the electric field is substantially uniform across the respective active sub-pixel region.

32. The display of claim 29 wherein the insulating material comprises insulating members extending linearly across the substrate and the base electrodes, the active sub-pixel regions also defined between adjacent insulating members.

33. The display of claim 32 wherein two gate electrodes extend in parallel on at least a portion of each insulating member.

34. The display of claim 33 wherein one of the two gate electrodes comprises one of the respective pair of gate electrodes defining an active sub-pixel region.

* * * * *